US012376657B2

(12) United States Patent
Campbell

(10) Patent No.: US 12,376,657 B2
(45) Date of Patent: Aug. 5, 2025

(54) MOBILITY ASSIST DEVICE INCLUDING EXERCISING COMPONENTS, AND SYSTEMS AND METHODS THEREOF

(71) Applicant: Colin Lloyd Campbell, Panama City, FL (US)

(72) Inventor: Colin Lloyd Campbell, Panama City, FL (US)

(73) Assignee: TherEx, LLC, Williamsburg, VA (US)

( * ) Notice: Subject to any disclaimer, the term of this patent is extended or adjusted under 35 U.S.C. 154(b) by 370 days.

(21) Appl. No.: 17/667,921

(22) Filed: Feb. 9, 2022

(65) Prior Publication Data

US 2022/0265010 A1 Aug. 25, 2022

Related U.S. Application Data

(60) Provisional application No. 63/147,421, filed on Feb. 9, 2021.

(51) Int. Cl.
*A45B 3/00* (2006.01)
*A45B 9/00* (2006.01)
(Continued)

(52) U.S. Cl.
CPC ..... *A45B 3/00* (2013.01); *A45B 9/02* (2013.01); *A63B 21/023* (2013.01);
(Continued)

(58) Field of Classification Search
CPC ..... A45B 3/00; A45B 9/02; A45B 2009/002; A45B 2009/007; A61H 3/02; A63B 21/023; A63B 21/025; A63B 21/04; A63B 21/0407; A63B 21/0421; A63B 21/0428; A63B 21/045; A63B 21/0455; A63B 21/055; A63B 21/0552; A63B 21/4027;
(Continued)

(56) References Cited

U.S. PATENT DOCUMENTS 3,635,233 A * 1/1972 Robertson ..... A61H 3/02 135/71
3,757,807 A * 9/1973 Manzo ..... A61H 3/02 135/81
(Continued)

FOREIGN PATENT DOCUMENTS

DE 202010008631 U1 * 2/2012 ..... A45B 3/00
FR 2979538 A1 * 3/2013 ..... A61H 3/02
(Continued)

OTHER PUBLICATIONS

Advocate Aurora Health, Cane Exercises—Aurora Health Care. Cane Exercises—Aurora Health Care, AuroraHealthcare.org, (Dec. 2019), Retrieved from the Internet: ahc.aurorahealthcare.org/fywb/x17468.pdf, 2 pages.
(Continued)

*Primary Examiner* — Gary D Urbiel Goldner
(74) *Attorney, Agent, or Firm* — COOLEY LLP

(57) ABSTRACT

Embodiments described herein relate generally to apparatuses and methods relating to mobility assist devices including, for example, walking canes. In some embodiments, a mobility assist device can include a wrist stabilizer and one or more exercising elements for enabling a user to perform torsion, rotation, grip, and/or other exercises.

26 Claims, 16 Drawing Sheets

(51) Int. Cl.

| | |
|---|---|
| ***A45B 9/02*** | (2006.01) |
| ***A63B 21/00*** | (2006.01) |
| ***A63B 21/02*** | (2006.01) |
| ***A63B 23/16*** | (2006.01) |

(52) U.S. Cl.
CPC ..... *A63B 21/4035* (2015.10); *A63B 23/16* (2013.01); *A45B 2009/002* (2013.01); *A45B 2009/007* (2013.01)

(58) Field of Classification Search
CPC ..... A63B 21/4033; A63B 21/4035; A63B 21/4047; A63B 21/4049; A63B 23/14; A63B 23/16; A63B 26/00; A63B 26/003; A63B 71/0009; A63B 71/0054; A63B 2225/09; A63B 2225/093
See application file for complete search history.

(56) References Cited

U.S. PATENT DOCUMENTS

| | | | | | |
|---|---|---|---|---|---|
| 4,151,853 | A * | 5/1979 | Inbar | A61H 3/02 | 135/69 |
| 4,589,655 | A * | 5/1986 | Ammon | A63B 23/14 | 482/46 |
| 5,281,192 | A * | 1/1994 | Nelson | A63B 21/4035 | 482/109 |
| 5,391,132 | A * | 2/1995 | Greenwald | A63B 21/4047 | 482/114 |
| 5,890,259 | A * | 4/1999 | Sarac | B25G 1/102 | 16/901 |
| 5,913,749 | A * | 6/1999 | Harmon | A63B 21/1672 | 482/129 |
| 5,954,074 | A * | 9/1999 | Mattson | A61H 3/02 | 135/69 |
| 6,085,766 | A * | 7/2000 | Geary | A63C 11/221 | 135/71 |
| 6,921,352 | B1 * | 7/2005 | Stearns | A63B 23/14 | 482/44 |
| 7,087,002 | B2 * | 8/2006 | Montgomery | A45B 7/005 | 135/65 |
| 7,950,975 | B1 * | 5/2011 | Chapman, Jr. | A63J 7/005 | 472/133 |
| 8,678,984 | B1 * | 3/2014 | Poillucci | A61H 23/0263 | 482/44 |
| 9,662,263 | B2 * | 5/2017 | Hsiao-Wecksler | A61F 5/01 | |
| 9,987,189 | B2 * | 6/2018 | Dropsho | A61H 3/02 | |
| 10,010,474 | B2 * | 7/2018 | Wang | A45B 3/00 | |
| 10,427,000 | B1 * | 10/2019 | Miller | A63B 21/015 | |
| 2004/0259699 | A1 * | 12/2004 | Montgomery | A63B 23/12 | 482/121 |
| 2006/0174449 | A1 * | 8/2006 | Hughes | A61F 4/00 | 16/110.1 |
| 2009/0114257 | A1 * | 5/2009 | Sutton | A61H 3/02 | 135/72 |
| 2011/0099765 | A1 * | 5/2011 | Youssefieh | A01D 7/00 | 15/147.1 |
| 2011/0105239 | A1 * | 5/2011 | Garno | A63B 60/00 | 473/238 |
| 2013/0190145 | A1 * | 7/2013 | Kugielsky | A63B 21/00058 | 482/110 |
| 2014/0053887 | A1 * | 2/2014 | Lee | A45B 9/04 | 135/69 |
| 2016/0101012 | A1 * | 4/2016 | Hsiao-Wecksler | A61H 3/02 | 135/71 |
| 2016/0151229 | A1 * | 6/2016 | Varghese | A61H 3/02 | 135/71 |
| 2016/0287464 | A1 * | 10/2016 | Younger | A45B 9/02 | |
| 2017/0196322 | A1 * | 7/2017 | Denmark | A61H 3/0244 | |
| 2018/0125739 | A1 * | 5/2018 | Herman, Jr. | A45B 3/00 | |
| 2019/0008715 | A1 * | 1/2019 | Younger | A61H 1/00 | |
| 2020/0008545 | A1 * | 1/2020 | Strum | A45B 9/02 | |
| 2020/0146924 | A1 * | 5/2020 | Younger | A61H 3/02 | |
| 2022/0015981 | A1 * | 1/2022 | Younger | A61H 3/0288 | |
| 2022/0022612 | A1 * | 1/2022 | Serlachius | A45B 7/00 | |
| 2022/0151860 | A1 * | 5/2022 | Shugert | A63B 23/03541 | |

FOREIGN PATENT DOCUMENTS

| | | | | | |
|---|---|---|---|---|---|
| GB | 2209934 | A * | 6/1989 | A45B 3/00 | |
| GB | 2264064 | A * | 8/1993 | A63B 21/0004 | |
| JP | 3605769 | B1 * | 12/2004 | A45B 9/00 | |
| JP | 6842018 | B1 * | 3/2021 | A61H 3/02 | |
| RU | 2753436 | C1 * | 8/2021 | A61H 3/00 | |
| WO | WO-2019191802 | A1 * | 10/2019 | | |

OTHER PUBLICATIONS

Amaral, C. A. et al. "Hand Grip Strength: Reference Values for Adults and Elderly People of Rio Branco, Acre, Brazil," PLoS ONE, 14(1):e0211452, U.S. National Library of Medicine, Public Library of Science, Jan. 2019, Retrieved from the Internet: www.ncbi.nlm.nih.gov/pmc/articles/PMC6354998/, 13 pages.

Bohannon, R. W., "Grip Strength: An Indispensable Biomarker For Older Adults," Clinical Interventions in Aging, vol. 14, Oct. 2019, pp. 1681-1691, doi:10.2147/cia.s194543.

Carmeli, E. et al., "The Aging Hand," The Journals of Gerontology: Series A, vol. 58A, No. 2, Feb. 2003, pp. M146-M152.

Huffman, M., "Use of Walking Aids Jumps 50% in 10 Years," ConsumerAffairs, Consumers Unified LLC, Feb. 2017, Retrieved from the Internet:www.consumeraffairs.com/news/use-of-walking-aids-jumps-50-in-10-years-051415.html, 3 pages.

Hugo Mobility, "Walking Cane Safety Step 2—Choosing Walking Canes for Safe Support," DeVilbiss Healthcare, Medical Depot, Inc. (2020), Retrieved from the Internet:https://hugoanywhere.com/walking-cane-safety-step-2-choosing-walking-canes-for-safe-support/, 5 pages.

Mather, M. et al., "Fact Sheet: Aging in the United States," Population Reference Bureau, Jul. 2019, Retrieved from the Internet: https://www.prb.org/resources/fact-sheet-aging-in-the-united-states/, 4 pages.

Mozes, A., "More Aging Americans Using Canes, Walkers," ConsumerHealth Day, HealthDay, May 2015, Retrieved from the Internet: consumer.healthday.com/senior-citizen-information-31/misc-aging-news-10/more-aging-americans-using-canes-walkers-699143.html, 3 pages.

NCOA, National Council on Aging, "Falls Prevention: Fact Sheet," 2016, Retrieved from the Internet: www.ncoa.org/resources/falls-prevention-fact-sheet/, 2 pages.

Press Release, "47,000 Older Adults Treated in Emergency Departments Annually for Fall Injuries Related to Walkers and Canes," Centers for Disease Control and Prevention, U.S. Department of Health and Human Services, Jun. 2009, Retrieved from the Internet: www.cdc.gov/media/pressrel/2009/r090629.htm, 2 pages.

Rogue Fitness, "The Gold Standard for Building and Testing Grip Strength," Captains of Crush Grippers, Rogue, 2020, Retrieved from the Internet: www.roguefitness.com/captains-of-crush-grippers?prod_id=2352gclid=Cj0KCQiA4NTxBRDxARIsAHyp6gAL3CSIvL48AGO4HuFwCRi1JrvOHOxmxLqCUhHVnFaLWyELmq5iFrEaAj3nEALw_wcB, 8 pages.

Tavernise, S. et al., "American Life Expectancy Rises for First Time in Four Years," The New York Times, The New York Times Company, Jan. 2020, Retrieved from the Internet: www.nytimes.com/2020/01/30/us/us-life-expectancy.html, 3 pages.

United States Census Bureau, "Older People Projected to Outnumber Children for First Time in U.S. History," The United States Census Bureau, USA.Gov, Mar. 2018, Retrieved from the Internet: www.census.gov/newsroom/press-releases/2018/cb18-41-population-projections.html, 4 pages.

"Walking Aids For Elder People And Patients," Indiamart.com, InterMESH Ltd., 2020, Retrieved from the Internet: www.indiamart.com/proddetail/walking-aids-for-elder-people-and-patients-12411050562.html, 6 pages.

(56) References Cited

OTHER PUBLICATIONS

"Walking Stick," Indiamart.com, InterMESH Ltd., 2020, Retrieved from the Internet: www.indiamart.com/proddetail/walking-stick-4700772748.html, 6 pages.
Wickremaratchi, M. M. et al., "Effects of Ageing on Touch," Postgraduate Medical Journal, vol. 82, No. 967, May 2006, pp. 301-304, National Library of Medicine, Retrieved on the Internet: www.ncbi.nlm.nih.gov/pmc/articles/PMC2563781/.
Wiraguna, A. et al., "Correlation of Handgrip Strength with Quality of Life in Elderly Patients," Journal of Physics: Conference Series, vol. 1073, Issue 4, 2018, doi:10.1088/1742-6596/1073/4/042033, 8 pages.

* cited by examiner

MOBILITY ASSIST DEVICE INCLUDING EXERCISING COMPONENTS, AND SYSTEMS AND METHODS THEREOF

CROSS-REFERENCE TO RELATED APPLICATIONS

This application claims the benefit of U.S. Provisional Application No. 63/147,421, filed Feb. 9, 2021, the content of which is hereby incorporated by reference in its entirety.

TECHNICAL FIELD

The system, devices, and methods described herein generally relate to mobility assist devices, and in particular, a walking cane including one or more exercising components.

BACKGROUND

Over fifty million adults are over the age of sixty-five, and more than eight million of them use walking aids such as canes. Walking canes can be used to assist in maintaining mobility and increase longevity and quality of life. Some individuals, however, do not possess sufficient strength to use a walking cane and/or are limited in their range with a walking cane. For example, the use of walking devices relies on a certain amount of hand grip and wrist strength from users.

Users that lack sufficient strength can encounter safety risks while using canes and/or be limited in their use of such devices. Fear of injury (e.g., falling) while using a walking aid can cause individuals to limit their activities and social engagements, which can lead to physical decline, depression, social isolation, etc. Fall preventing strategies can be useful in assisting users with using walking aids, but require individuals to have sufficient grip and/or lifting strength.

Accordingly, improved devices and methods are needed for increasing mobility and strength.

DETAILED DESCRIPTION

Devices and methods for aiding mobility of a user are described herein. Systems, devices, and methods described herein relate to a mobility assist device, which includes elements for providing stability for walking as well as exercising elements for strengthening a user. In some embodiments, a mobility assist device can be a walking cane, equipped with a wrist support and one or more exercising elements (e.g., hand, finger grip, and wrist exercise devices) in a compact form factor. The exercising components can be designed to strengthen areas for maintaining safe control of the cane and to improve mobility.

I. Systems and Devices

Figure 1:
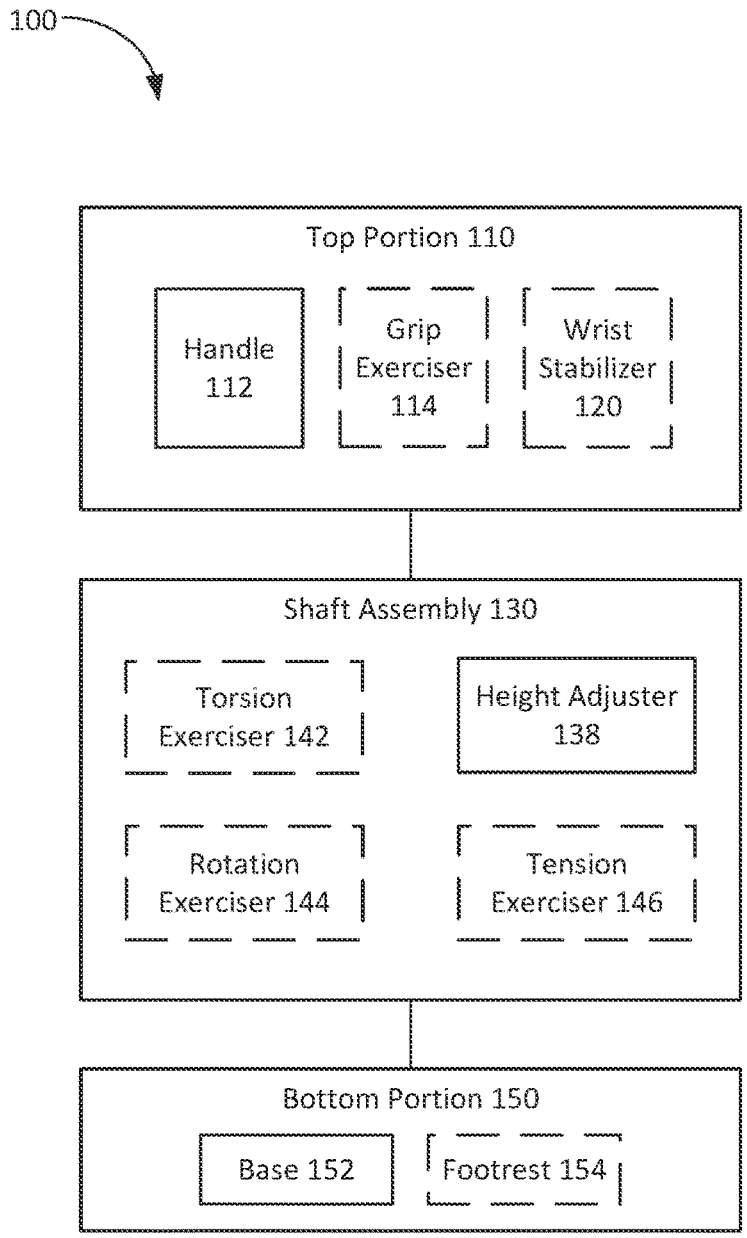
FIG. 1 is a schematic block diagram of an example mobility assist device, according to embodiments.

FIG. 1 is a block diagram of an example mobility assist device 100. In some embodiments, the mobility assist device 100 can be a walking cane. The mobility assist device 100 can include a top portion 110, a shaft assembly 130, and a bottom portion 150.

The top portion 110 can include a handle 112 and optionally can include one or more of a grip exerciser 114 or a wrist stabilizer 120. The handle 112 may have a size and shape configured to be gripped by a hand of a user. The grip exerciser 114 can be used to strengthen a grip of a user. The grip exerciser 114 can include, for example, one or more handles that can be gripped by a user to perform a grip exercise. The handle(s) can be mounted on resistance bearing components, e.g., springs, elastic bands, etc. that can provide resistance to moving the handle(s). The handles can be padded and/or covered with other material that facilitates friction between the fingers of a user and the handle. In some embodiments, the grip exerciser 114 can be disposable within a shaft and/or handle (e.g., handle 112) of the mobility assist device 110 when not in use, e.g., to avoid interfering with the user of the walking cane for other purposes. For example, the grip exerciser 114 can be pushed within the handle 112 of the mobility assist device 110, and can be locked within the handle 112 via a locking mechanism (e.g., a locking pin) when not in use. When a user desires to use the grip exerciser 114, the user can then unlock the locking mechanism to release the grip exerciser 114 for use. Further details of such an embodiment are provided with respect to FIGS. 10B and 10C. In some embodiments, the grip exerciser 114 can be removable from the mobility assist device 100 when not in use. In some embodiments, the group exerciser 114 can extend substantially parallel to the handle 112 of the mobility assist device 110, such that a user can place his palm on the handle 112 and use his fingers to move the grip exerciser 114 to perform a grip exercise. Further details of such exercises are described with reference to FIG. 6.

In some embodiments, the top portion 110 of the mobility assist device 100 can include a wrist stabilizer 120. The wrist stabilizer 120 can provide wrist support to a user in flexion and/or extension. The wrist stabilizer 120 can include a frame with one or more sections that provide three points of support to a user's arm and hand. For example, the wrist stabilizer 120 can include a forearm support, a wrist support, and a handle (e.g., handle 112). Further details of an example wrist stabilizer are described with reference to FIG. 2.

The shaft assembly 130 can include a height adjuster 138 and optionally can include one or more exercise elements, including, for example, a torsion exerciser 142, a rotation exerciser 144, and/or a tension exerciser 146. The shaft assembly 130 can include a plurality of shafts, e.g., elongate members, that are coupleable to one another and to the top portion 110 and/or bottom portion 150. The height adjuster 138 can be configured to allow adjustments of a height or length of the shaft assembly. For example, the height adjuster 138 can include pins (e.g., locking pins or ball pins) that can extend from one shaft into openings or holes in another shaft (e.g., at discrete heights or points) to lock the relative spacing of the two shafts relative to one another. In such manner, the height adjuster 138 can be used to increase and/or decrease a height of the mobility assist device 100, e.g., to allow users of different heights to use the mobility assist device 100 and/or to make the mobility assist device 100 better suited for performing certain exercises, as described in FIG. 6.

The shaft assembly 130 can support the one or more exercise components, including the torsion exerciser 142, the rotation exerciser 144, and/or the tension exerciser 146. The torsion exerciser 142, the rotation exerciser 144, and/or the tension exerciser 146 can be configured to increase wrist, hand, and/or arm strength of a user. The torsion exerciser 142 can include one or more elastic elements (e.g., spring, elastic band, elastic padding, elastic foam or other material, etc.) that can provide resistance in torsion. The elastic element(s) can be mounted onto one or more shafts of the shaft assembly 130, and can extend along a longitudinal axis of the shaft assembly 130. The torsion exerciser 142 can include sections at or near its ends that allow a user to grip the ends and apply torsion (e.g., twist or rotate) to the elastic element about a longitudinal axis of the shaft assembly 130. These sections can include, for example, padded or increased friction material for increasing grip and/or handles. In an embodiment, the torsion exerciser can be a tennis elbow bar or resistance bar. Further details of a torsion exerciser are provided with reference to FIGS. 11A-11C. The rotation exerciser 144 can include one or more grips (e.g., padded sections) that enable a user to hold one or more shafts of the shaft assembly 130 and rotate the mobility assist device 100, e.g., in a circumferential or circular motion. The grip(s) can be supported on one or more shafts of the shaft assembly 130. Further details of a rotation exerciser are provided with reference to FIG. 12. The tension exerciser 146 can include a resistance band or other elastic element (e.g., spring, elastic band, etc.) that can be coupled to one or more portions of the shaft assembly 130. A user can grip portions of the shaft assembly 130 and/or other portions of the mobility assist device 100 (e.g., a base 152 and/or footrest 154) to stretch or elongate the resistance band to perform a tension exercise, as described in more detail with reference to FIG. 6. In an embodiment, the tension exerciser 146 can be a resistance tubing that is tied (e.g., attached) at its ends to different shafts of the shaft assembly 130, and the two shafts can be moved apart (e.g., pulled apart) from one another to perform a tension exercise.

The bottom portion 150 can include a base 152 and optionally can include a footrest 154. In some embodiments, the base 152 can include one or more legs that extend laterally out from a center of the base, e.g., to provide additional stability for a user of the mobility assist device 100. In some embodiments, a base 152 may be configured for a predetermined terrain and/or environment (e.g., indoor, pavement, snow). For example, if adapted for snow, the base can include one or more extensions that keep the cane supported in snow to maintain balance while walking on snow. In some embodiments, the base 152 may include one or more springs, e.g., as an exercise in balance for a user and/or to reduce impact forces. The footrest 154 can include one or more platforms or legs that extend laterally out from a longitudinal axis of the mobility assist device 100. In some embodiments, the footrest 154 can be configured to be folded along and/or within the shaft assembly 130 and/or bottom portion 150 when not in user, e.g., to prevent interfering with other use of the mobility assist device 100 (e.g., for walking). In some embodiments, the footrest 154 can be used to perform a tension exercise, as further described with reference to FIG. 6. In some embodiments, a locking mechanism such as a pin, button, latch, etc. can be used to hold the footrest 154 in a folded or locked configuration and can be released (e.g., unlocked) to release the footrest 154.

In some embodiments, the shaft assembly 130 may be coupled between the top portion 110 and the bottom portion 150. For example, the top portion 110 may be releasably coupled to a first end of the shaft assembly 130 and the bottom portion 150 may be releasably coupled to a second end of the shaft assembly 130.

Figure 2:
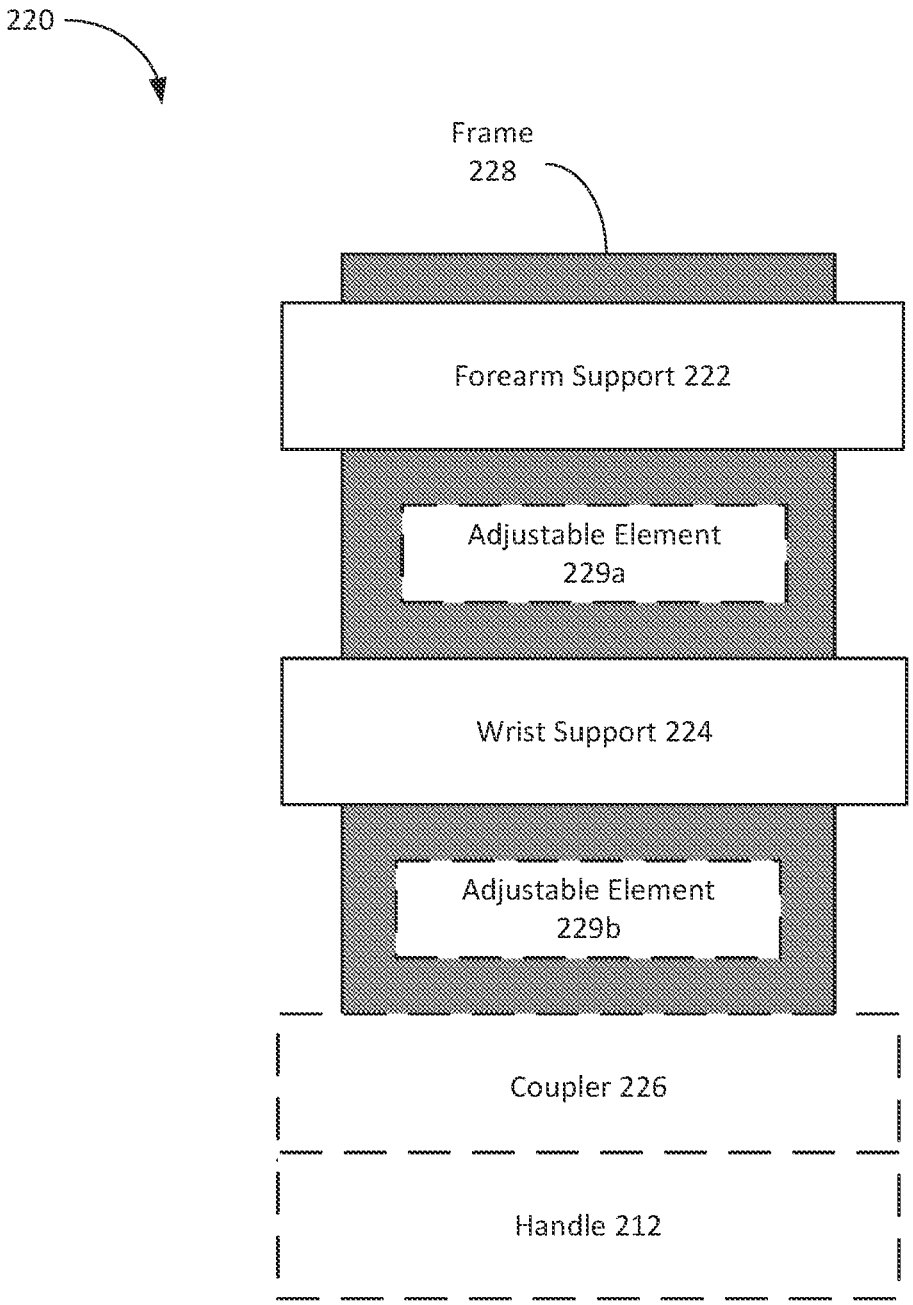
FIG. 2 is a schematic block diagram of an example wrist stabilizer of a mobility assist device, according to embodiments.

FIG. 2 is a schematic block diagram of an example wrist stabilizer 220 of a mobility assist device, according to embodiments. The wrist stabilizer 220 can be used with any of the mobility assist devices described herein, including, for example, mobility assist device 100. The wrist stabilizer 220 can include components that are structurally and/or functionally similar to the wrist stability 120.

The wrist stabilizer 220 may comprise one or more of a forearm support 222, wrist support 224, and frame 228. Optionally, one or more adjustable elements 229*a*, 229*b* (e.g., hinges, flexible tubing, springs, or other elastic, deformable, or adjustable components) can be used to couple one or more components of the wrist stabilizer 220 to each other. For example, in some embodiments, a first adjustable element 229*a* such as a hinge or flexible tubing can be used to couple the forearm support 222 to the frame 228 of the wrist stabilizer 220. In some embodiments, a second adjustable element 228*b* can be used to couple the wrist support 224 to the frame 228. The second adjustable element 228*b* can be a loop, ring, or other suitable structure that attaches the wrist support 224 to the frame 228 but allows the wrist support 224 to move (e.g., slide) to different locations along the frame 228. By allowing the wrist support 224 to move along the frame 228, a user with a longer or shorter arm can change the location of the wrist support 224 such that it is positioned at their wrist.

In some embodiments, the frame 228 can be adjustable in length, e.g., such that the wrist stabilizer 220 can be configured for use by users with different lengths of arms. In some embodiments, the frame 228 can include slidable members that can slide relative to one another to reduce or increase a length of the frame 228. In some embodiments, the frame 228 can include a compressible structure (e.g., a compressible tubing, such as an accordion-like tubing) that can compress to shorten and/or expand to lengthen.

The forearm support 222 can be configured to support to a forearm of the user. In some embodiments, the forearm support 222 can include a support beam or member (e.g., a bar) for contacting and supporting the forearm of the user. In some embodiments, the forearm support 222 can include padding or other soft material for aiding in comfort. The wrist support 224 can be configured to support a wrist of the user. In some embodiments, the wrist support 224 can include a flexible band that is configured to wrap around one side of the wrist of the user. The wrist support 224 can be formed from a piece of fabric, plastic, or other flexible material. The wrist support 224 can be coupled to the frame 228 by one or more loops, such as, for example, a loop formed by the flexible material. In use, the forearm support 222 can be used to support a forearm of the user on a first side of the forearm (e.g., a posterior side of the forearm) and the wrist support 224 can be used to support the wrist of the user on the opposite side (e.g., an anterior side of the wrist). The user can then grip the handle 212 of a mobility assist device (e.g., a walking cane), and together with the forearm support 222 and the wrist support 224, the user can be supported in flexion and/or extension, depending on the specific arrangement of the forearm support 22 and the wrist support 224 relative to the user's forearm and wrist. Further details of such are provided with reference to FIG. 5.

In some embodiments, the wrist stabilizer 220 can be integrated into a top portion of a mobility assist device (e.g., mobility assist device 100) and therefore be directly attached a handle 212. Alternatively, the wrist stabilizer 220 can be removably attachable via a coupler 226 to a handle or top portion of a mobility assist device (e.g., mobility assist device 100). FIGS. 7A-9 depict one or more components of an example wrist stabilizer, as described in more detail herein.

Figure 3:
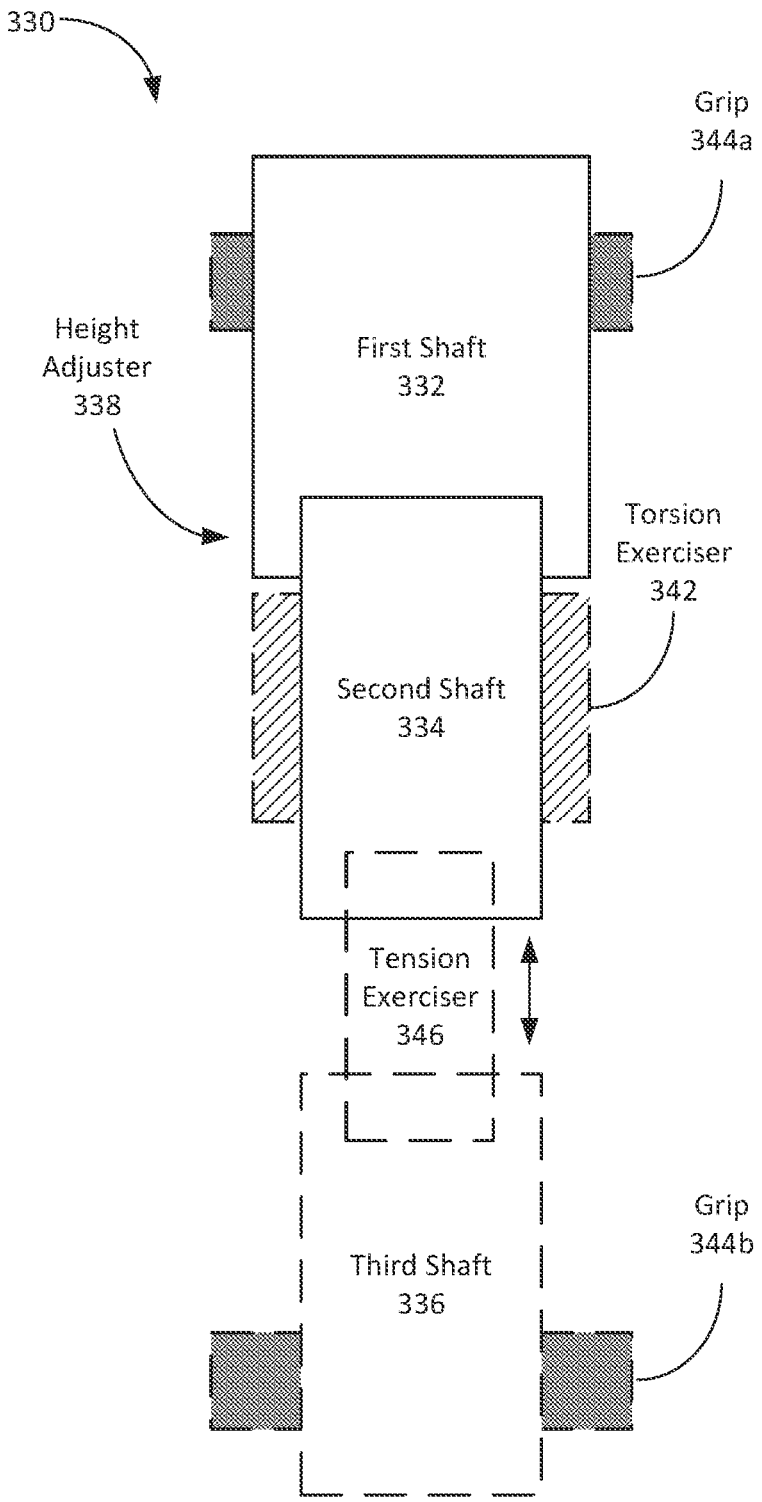
FIG. 3 is a schematic block diagram of an example shaft assembly of a mobility assist device, according to embodiments.

FIG. 3 is a schematic block diagram of a shaft assembly 330 of a mobility assist device. The shaft assembly 330 can be used with any of the mobility assist devices described herein, including, for example, mobility assist device 100. The shaft assembly 330 can include components that are structurally and/or functionally similar to the shaft assembly 130. For example, the shaft assembly 330 can include a plurality of shafts, e.g., a first shaft 332 and a second shaft 334 and optionally one or more additional shafts (e.g., a third shaft 336).

One of more of the first shaft 332, second shaft 334, and third shaft 336 may comprise a height adjuster 338. The height adjuster 338 may enable a user to adjust a length of the second shaft 334 such that a mobility assist device is at a desired height for walking and/or exercising. In some embodiments, the height adjuster 338, similar to the height adjuster 138, can include one or more pins (e.g., ball pins) on one shaft (e.g., second shaft 334 that can fit into different openings or holes within another shaft (e.g., first shaft 332) to adjust a height of the shaft assembly 330. The pins can lock into place in the different openings to lock the height of the shaft assembly 330 at a plurality of different heights.

Optionally, the shaft assembly 330 can support a variety of exercising elements. In some embodiments, the plurality of shafts can include one or more grips, e.g., the first shaft 332 may comprise a first grip 344*a*, and the third shaft 336 may comprise a second grip 344*b*. The grips 344*a*, 344*b* may be configured to enable a user to grip and rotate the shaft assembly 330, e.g., in a circumferential manner to perform a rotation exercise. In some variations, one or more of the first shaft 332, second shaft 334, and third shaft 336 may comprise a torsion exerciser 342. The torsion exerciser 342 may be configured to enable a user to rotate their hands about a longitudinal axis of the shaft assembly 330 while exerting a force on the torsion exerciser 342. The torsion exerciser 342, similar to the torsion exerciser 142, can include one or more elastic elements (e.g., spring, elastic band, elastic padding, elastic foam or other material, etc.) that can provide resistance in torsion. The torsion exerciser 342 can optionally include one or more handles or grips for exerting torsion on the elastic element(s), e.g., to perform a torsion exercise. Alternatively, a user can use grips 344*a*, 344*b* to exert torsion on the one or more elastic elements of the torsion exerciser 342. In some variations, a tension exerciser 346 may be coupled between two of the shafts, e.g., the second shaft 334 and the third shaft 336. The tension exerciser 346 may be configured to be extended, e.g., put in tension. For example, one end of the tension exerciser 346 (e.g., second shaft 334) may be held in place while the other end of the tension exerciser 346 (e.g., third shaft 336) can be extended (e.g., pulled) away from the second shaft 334. In some embodiments, the tension exerciser 346 can include a resistance band that is attached at its ends to different shafts. The resistance band can be secured to the shafts in any number of suitable ways, e.g., by tying, adhesion, magnets, etc. In some embodiments, the opposite ends of the tension exerciser 346 can be pulled away from each other at an angle of between about 90 degrees and about 180 degrees. In some embodiments, the tension exerciser 346 in a resting configuration may be covered by one or more of the shafts, e.g., the second shaft 334 and the third shaft 336. That is, the tension exerciser 346 may be hidden from external view and/or stored within the shaft assembly when not in use. Therefore, the tension exerciser 346 can enable the mobility assist device to maintain a compact form factor and/or avoid interfering with a user's use of the mobility assist device in another function (e.g., walking and/or a different exercise).

While grips 344*a*, 344*b*, torsion exercise 342, and tension exerciser 346 are described herein with reference to the shaft assembly 330, it can be appreciated that the shaft assembly 330 can include other exercising elements as well. For example, the shaft assembly 330 can include a grip exerciser (e.g., similar to grip exerciser 114), a cable exerciser, etc. Alternatively or additionally, the shaft assembly 330 can include a plurality of exercising elements, e.g., multiple resistance bands, multiple grips, multiple torsion bars, etc.

Figure 4:
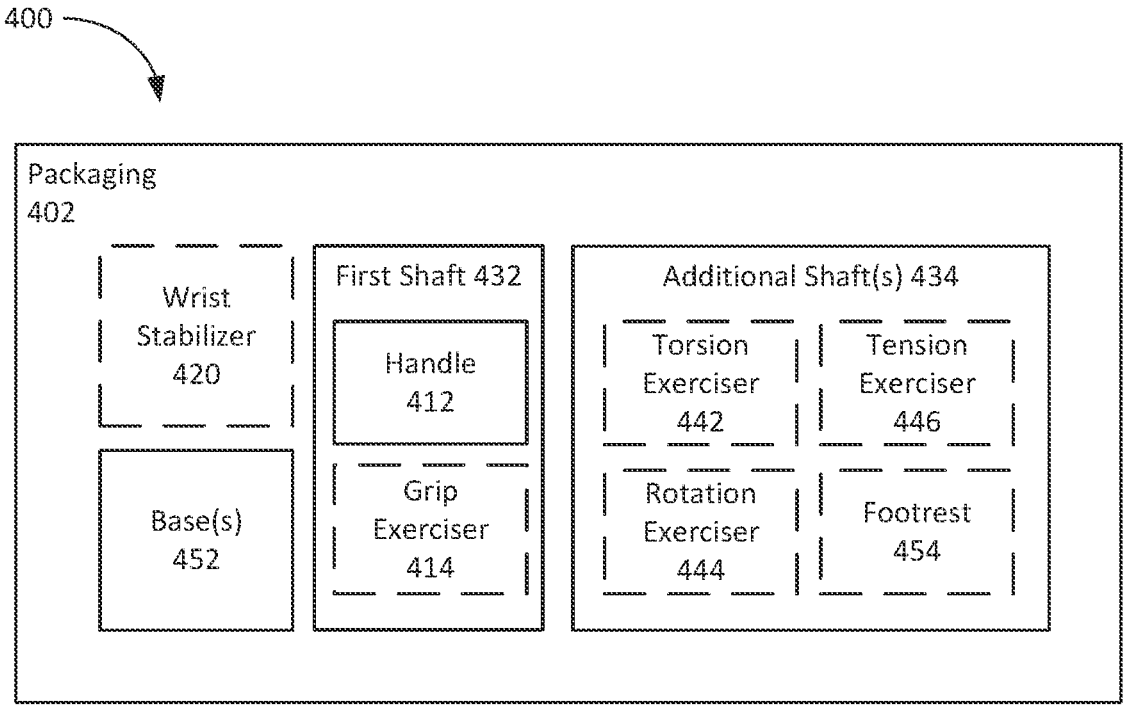
FIG. 4 is a schematic block diagram of an example kit including one or more components of a mobility assist device, according to embodiments.

FIG. 4 is a block diagram of a kit 400 comprising one or more components of a mobility assist device, according to embodiments. The components of the mobility assist device contained in the kit 400 can be structurally and/or functionally similar to components of the mobility assist devices described herein, including, for example, mobility assist device 100, wrist stabilizer 120, 220, shaft assembly 130, 330, etc. For example, kit 400 can include packaging 402 that contains a plurality of shafts including a first shaft 432 and one or more additional shaft(s) 434 (e.g., a second shaft 334). The kit 400 can also contain one or more base(s) 452.

The components of kit 400 can be used to construct a mobility assist device, such as any of the mobility assist devices described herein. For example, a user can obtain a kit 400 including components that the user desires to have in a mobility assist device, and construct those components together to form a mobility assist device. Depending on a user's needs, the user can select to have different bases, exercising elements, shafts, etc. within the kit 400, and the user can then construct a customized mobility assist device using the components of the kit 400.

In some embodiments, the kit 400 can include a handle 412, a plurality of shafts 432, 434, and one or more base(s) 452 and can optionally include one or more of a wrist stabilizer 420, a grip exerciser 414, a torsion exerciser 442, a rotation exerciser 444, a tension exerciser 446, and a footrest 454. One or more of the base(s) 452, handle 412, wrist stabilizer 420, grip exerciser 414, torsion exerciser 442, rotation exerciser 444, tension exerciser 446, or footrest 454 can be integrated into and/or coupleable to one or more of the shafts 432, 434.

In some embodiments, the kit 400 can include instructions to a user for assembling the one or more components within the kit 400 to construct the mobility assist device. In some embodiments, the kit 400 can include a mobility assist device that has been fully assembled and includes the various components depicted in FIG. 4. In some embodiments, the kit 400 can include instructions for using the various components of the mobility assist device and/or instructions for exercise routines (e.g., using the exercising components of the mobility assist device), etc.

Figure 7A:
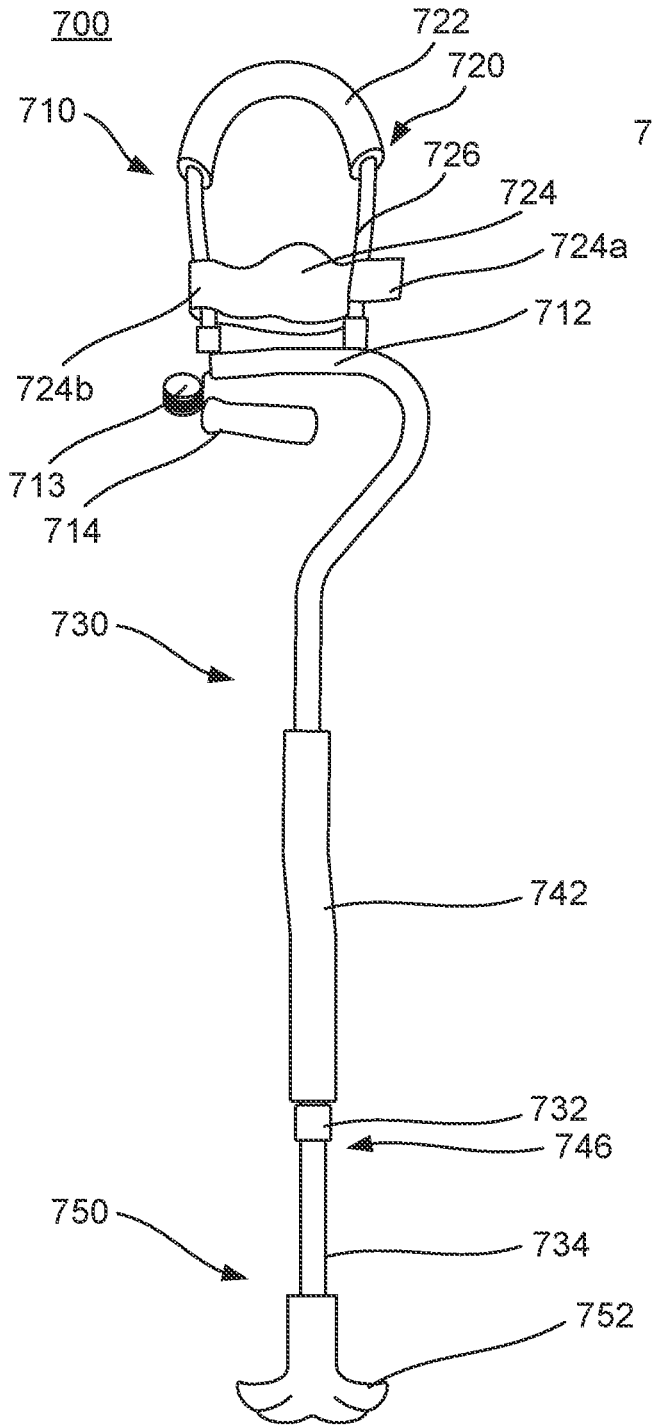
FIGS. 7A and 7B are side views of an example mobility assist device, according to embodiments.
Figure 7B:
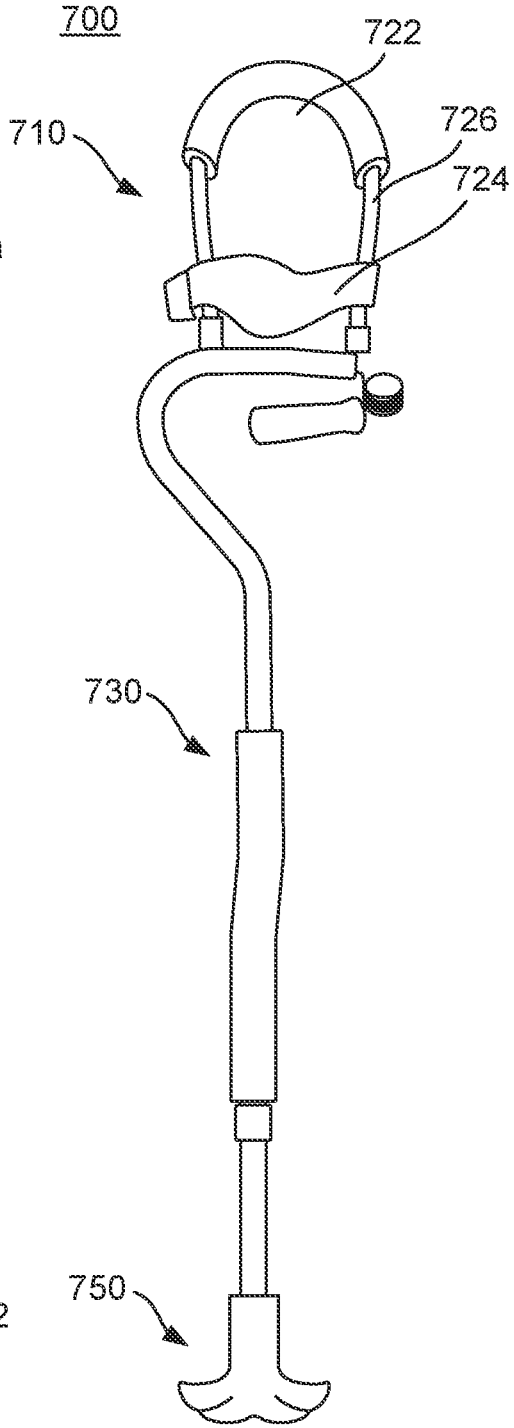

FIGS. 7A and 7B depict side views of a mobility assist device implemented as a walking cane 700 comprising a top portion 710, a shaft assembly 730, and a bottom portion 750. The walking cane 700 can include components that are functionally and/or structurally similar to the components of other mobility assist devices described herein (e.g., mobility assist device 100). For example, the top portion 710 of the walking cane 700 may include a handle 712, a grip exerciser 714, and a wrist stabilizer 720. The shaft assembly 730 of the walking cane 700 may include a torsion exerciser 742 and a tension exerciser 746. The bottom portion 750 of the walking cane 700 can include a base 752.

The wrist stabilizer 720 can include a forearm support 722 that is attached via one or more frame members 726 (e.g., support beams or rods) to the handle 712. The wrist stabilizer 720 can also include a wrist support 724 which is coupled at its two ends 724*a*, 724*b* to the frame members 726. The wrist support 724 can be a double layer fabric that loops around the frame members 726 at 724*a*, 724*b* to couple the fabric to the frame member 726. In some embodiments, the height of the wrist support 724 relative to the handle 712 can be adjusted, e.g., by sliding the wrist support 724 at its coupling points 724*a*, 724*b* along the frame member 726. The wrist support 724, when coupled to the frame members 726, can be loosely arranged (e.g., have some slack) such that a user can slide his wrist down through the wrist support 724 and grip the handle 712. The forearm support 722 can include a curved bar (e.g., in the shaft of a "U") that includes padding for providing comfort to the user. In some embodiments, the frame members 726 can be height adjustable. In some embodiments, the wrist stabilizer 720 can be coupled to the handle 712 at a predetermined or adjustable angle.

The walking cane 700 can include a plurality of exercising components, including the grip exerciser 714, the torsion exerciser 742, and the tension exerciser 746. The walking cane 700 can also include points along its shaft assembly 730 that can be gripped by a user to perform rotation exercises. The grip exerciser 714 can be coupled below the handle 712, as depicted in FIG. 7A. The grip exerciser 714 can be coupled to the handle 712 via a joint 713 with a spring, whereby the spring adds resistance to the movement of the grip exerciser 712. In use, a user can place his palm against the handle 712 and fingers around the grip exerciser 714 and then squeeze (e.g., tighten his grip) around the grip exerciser 714 to perform a grip exercise. The grip exerciser 714 can include padding along its length to increase friction along its surface so that a user can better grip the grip exerciser 714 during use.

The torsion exerciser 742 can include a resistance bar formed of an elastic foam-like material that a user can grip at its ends and apply torsion (e.g., rotate in opposite directions about a longitudinal axis of the shaft assembly 730. The tension exerciser 746 can be disposed within inner lumens (or hollow space) within the shafts of the shaft assembly 730. The tension exerciser 746 can include, for example, a resistance band that can be stretched in tension to perform a tension exercise. The resistance band can be coupled to two different shafts 732, 734, and the two shafts 732, 734 can be pulled away from one another to apply tension to the resistance band. In some embodiments, the resistance band can be coupled to the two shafts 732, 734 by being tied to the two shafts 732, 734. In some embodiments, when the two shafts 732, 734 are pulled away from one another, the resistance band can be exposed from its location within the shafts. In other embodiments, the two shafts 732, 734 can be arranged in a telescoping manner such that pulling on one shaft relative to the other extends the one shaft out from the other shaft a greater distance, thereby applying tension to the resistance band.

Figure 8A:
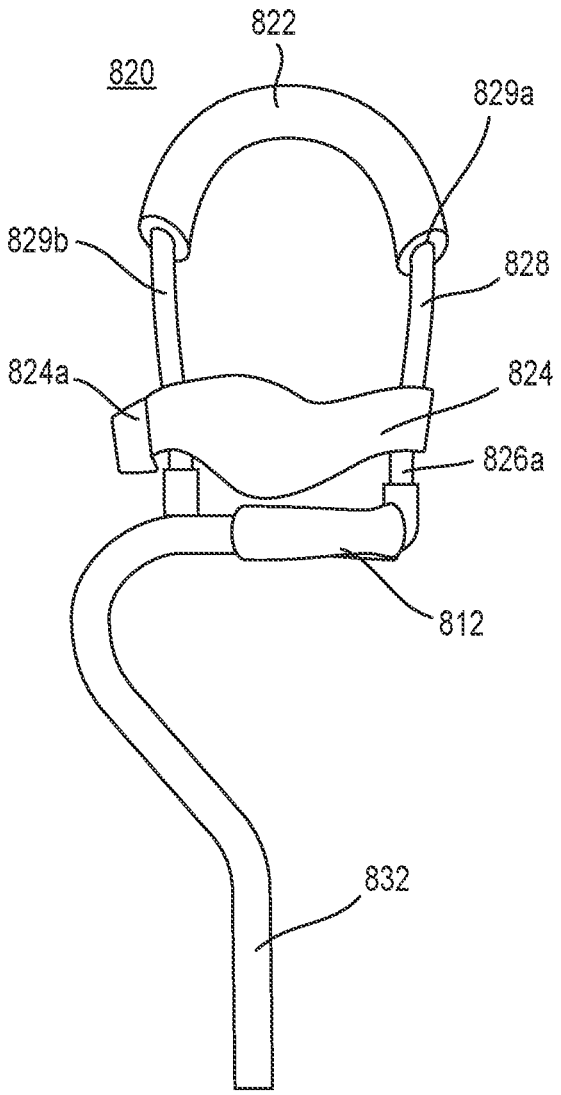
FIGS. 8A and 8B are side views of an example wrist stabilizer of a mobility assist device, according to embodiments.
Figure 8B:
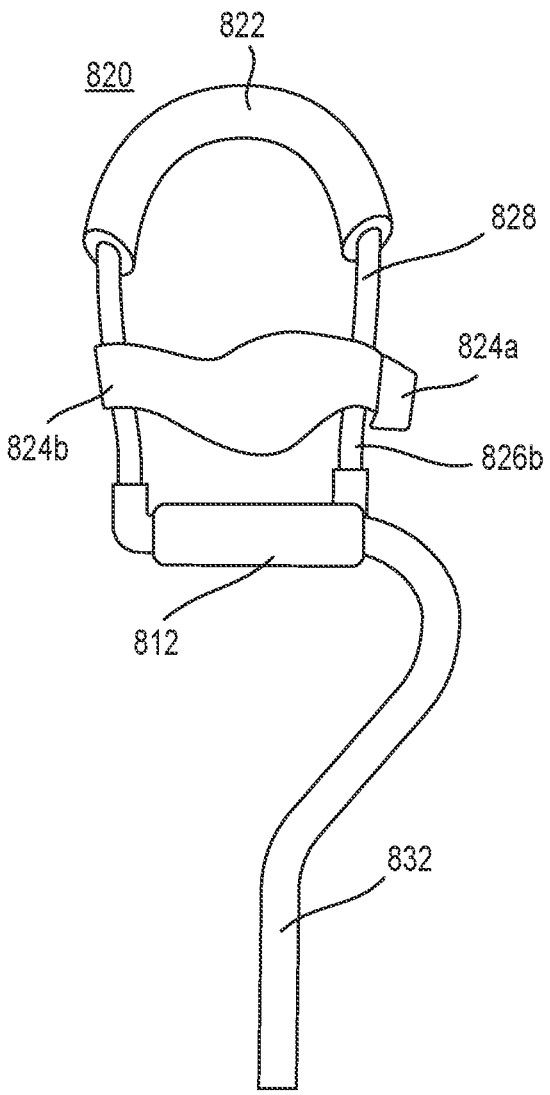
Figure 8C:
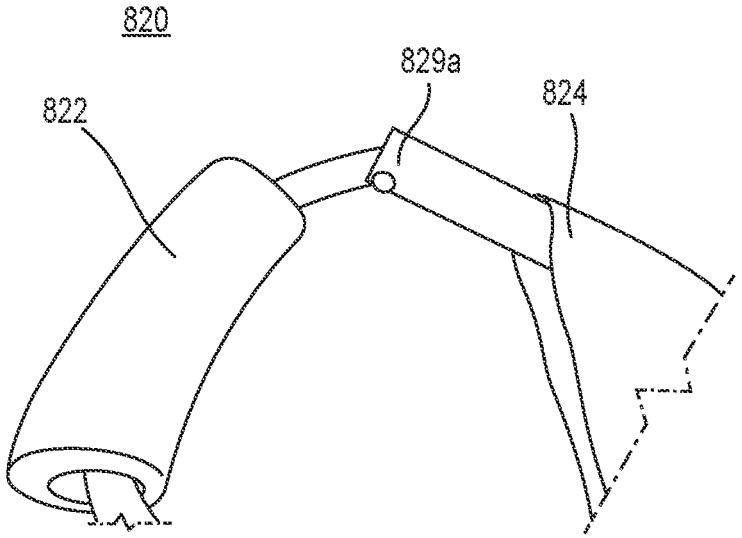
FIG. 8C is an enlarged view of an connection point of the example wrist stabilizer depicted in FIGS. 8A and 8B.

FIGS. 8A-8C depict different views of an alternative design of a wrist stabilizer 820 of a mobility assist device, according to embodiments. The wrist stabilizer 820 can be used with any of the mobility assist devices described herein, including, for example, mobility assist device 100 and walking cane 700. When used with walking cane 700, the wrist stabilizer 820 can replace the wrist stabilizer 720.

Figure 8D:
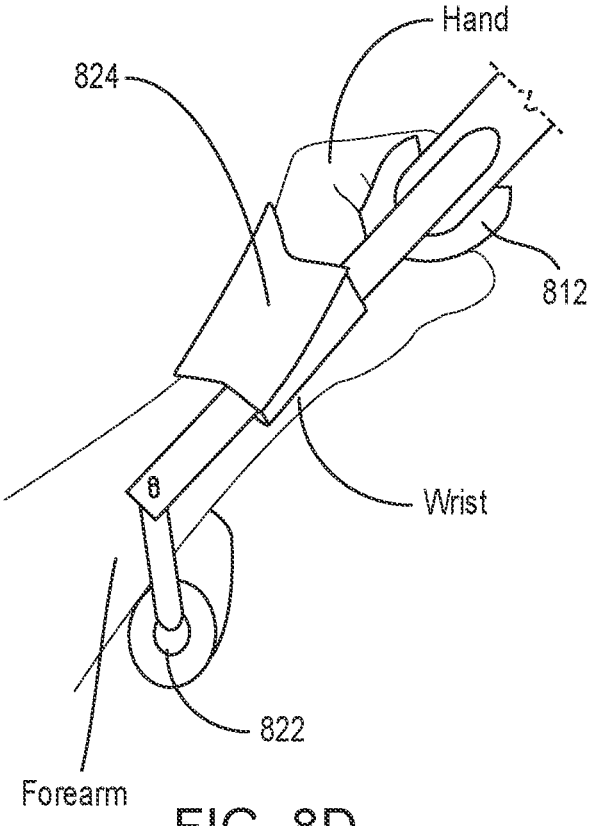
FIGS. 8D and 8E are views of a user using the example wrist stabilizer depicted in FIGS. 8A and 8B.

The wrist stabilizer 820 can include components that are functionally and/or structurally similar to other wrist stabilizers described herein (e.g., wrist stabilizer 120, 220, 720). For example, the wrist stabilizer 820 can include a forearm support 822, wrist support 824, and handle 812. The wrist stabilizer 820 can be similar to the wrist stabilizer 720 but include one or more hinged connections 829*a*, 829*b* between the forearm support 822 and frame members 826*a*, 826*b*. The frame members 826*a*, 826*b* can be configured to support the forearm support 822 and wrist support 824 and couple them to the handle 812. The frame members 826*a*, 826 can be rods or beams. The hinged connections 829*a*, 829*b* allow the forearm support 822 to be angled relative to the frame members 826*a*, 826*b* (or a longitudinal axis of the wrist stabilizer 820) in one or both lateral directions, such that a user's forearm and wrist can be held in a more natural arrangement (e.g., generally straight relative to one another), as depicted in FIG. 8D. The angle between the forearm support 822 and the frame members 826*a*, 826*b* can be about 10 degrees to about 60 degrees, or about 20 degrees to about 45 degrees, or about 30 degrees to about 45 degrees, including all values and subranges in-between. In an embodiment, the hinged connections 829*a*, 829*b* can be configured to allow the forearm support 822 to be angled relative to the frame members 826*a*, 826*b* by less than about 45 degrees in both lateral directions. The hinged connections 829*a*, 829*b* enable the forearm support 822 to be positioned to provide flexion support or extension support as desired. The wrist support 824 can be fixed to the frame components 826*a*, 826*b* or can be adjustable (e.g., by sliding the wrist support 824 along the frame components 826*a*, 826*b*).

The wrist stabilizer 820 can be integrally attached to an upper end of a shaft 832 of a shaft assembly of a mobility assist device. Alternatively, the wrist stabilizer 820 can be removably coupled to an upper end of the shaft 832, e.g., such that the wrist stabilizer 820 can be removed when not needed. Having the wrist stabilizer 820 be removable can assist in reducing the weight and/or size of the device, e.g., when the device is being used for an exercise (e.g., as described with reference to FIG. 6) instead of being used for walking, when a different handle or support is to be used, or when a user desires to use the device for a short distance that does not necessitate the wrist stabilizer 820.

Figure 8E:
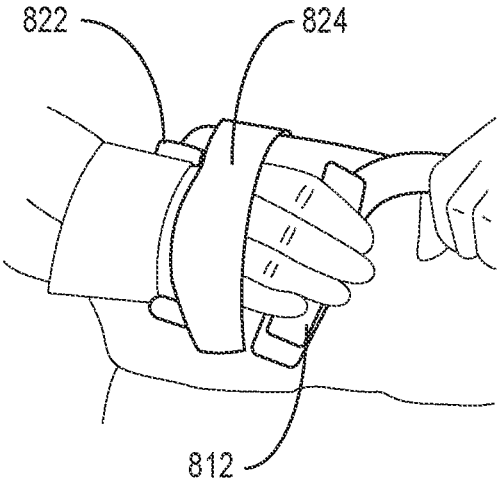

A user utilizing the wrist stabilizer 820 may gain additional stability and/or confidence in using a mobility assist device. FIGS. 8D and 8E depict a user having positioned their hand within the wrist stabilizer 820. As depicted, the user can be using the wrist stabilizer 820 to support the user in extension, e.g., as described in FIG. 5, where the forearm support 822 is on the anterior side of a forearm and the wrist support 824 is on a posterior side of the wrist. Alternatively, as described with respect to FIG. 5, the wrist stabilizer 820 can be used to support a user's wrist in flexion, where the forearm support 822 is on a posterior side of the forearm and the wrist support 824 is on an anterior side of the wrist.

Figure 9:
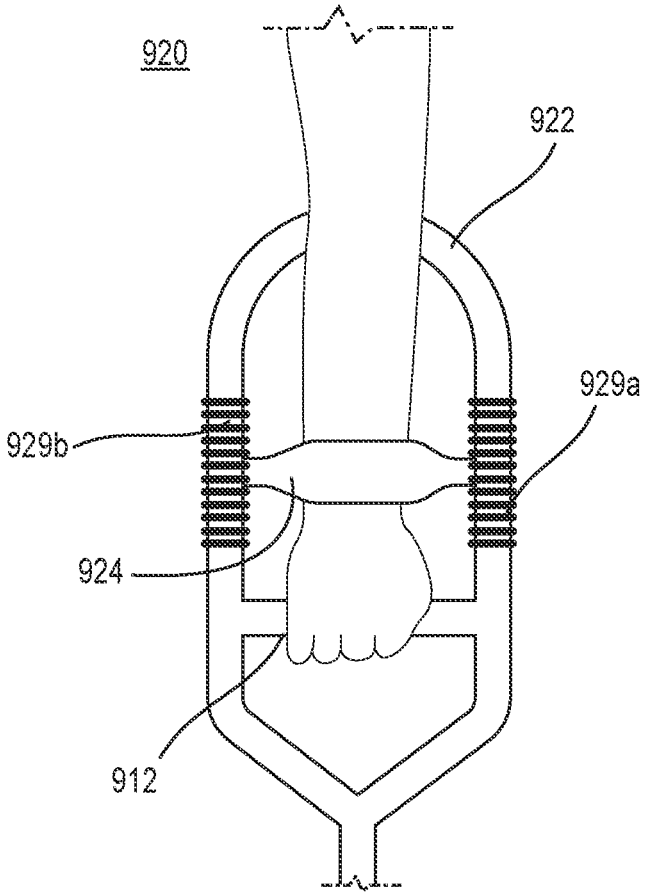
FIG. 9 is a schematic diagram of an example wrist stabilizer of a mobility assist device, according to embodiments.

FIG. 9 schematically depicts another design of a wrist stabilizer 920 of a mobility assist device, according to embodiments. The wrist stabilizer 920 can include components that are functionally and/or structurally similar to other wrist stabilizers described herein (e.g., wrist stabilizer 120, 220, 720, 820). For example, the wrist stabilizer 920 may comprise a handle 912, forearm support 922, and a wrist support 924. The wrist stabilizer 920 can be similar in structure and function to the wrist stabilizer 820, except that the wrist stabilizer 920 can include frame members having flexible or deformable portions 929*a*, 929*b*. The flexible portions 929*a*, 929*b* can be, for example, flexible tubing, springs, or other elastic material that allows the forearm support 922 to move or be angled relative to the handle 912, e.g., similar to the hinged connections 829*a*, 829*b*. Unlike the hinged connections 829*a*, 829*b*, the flexible portions 929*a*, 929*b* can allow the forearm support 922 to move in multiple degrees of freedom relative to the other elements of the wrist stabilizer 920. For example, the flexible portions 929*a*, 929*b* can allow the forearm support 922 to translate and/or rotate relative to a longitudinal axis of the wrist stabilizer 920. The flexible portions 929*a*, 929*b* may comprise a predetermined spring force that may enable a predetermined force to be applied to the forearm and wrist via a respective forearm support 922 and wrist support 924.

While the flexible portions 929*a*, 929*b* are depicted in FIG. 9 as extending a portion of the wrist stabilizer 920, it can be appreciated that a flexible structure (e.g., flexible tubing) can form a larger portion of the wrist stabilizer 920. For example, in some embodiments, a single flexible tubing can extend from a first side of a handle (e.g., handle 912) of the mobility assist device to another side of the handle in a U-shaped configuration. The upper portion of the flexible tubing can then function as the forearm support, and the wrist support can be coupled to the flexible tubing along a middle section of the flexible tubing. In such configurations, the flexible tubing can be configured to provide further movement/adjustability of the forearm support and/or wrist support. In some embodiments, the flexible portions 929*a*, 929*b* can be compressible to reduce a length of the wrist support and/or extendable to increase a length of the wrist support.

Figure 10A:
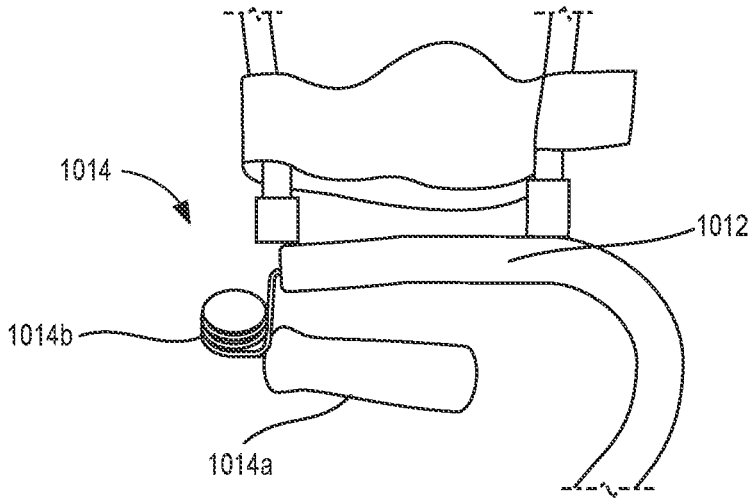
FIG. 10A is an enlarged view of an example grip exerciser of a mobility assist device, according to embodiments.

FIG. 10A depicts an enlarged view of a grip exerciser 1014 of a mobility assist device, according to embodiments. The grip exerciser 1014 can be functionally and/or structurally similar to other grip exercisers described herein, including, for example, grip exerciser 714. The grip exercise 1014 can be used with any one of the mobility assist devices described herein. The grip exerciser 1014 can be adjacent or in close proximity to a handle 1012 of the mobility assist device. This location can be convenient for a user's hand while maintaining a compact form factor. In some embodiments, the user can simultaneously walk using the mobility assist device and exercise their hand using the grip exerciser 1014. The grip exerciser 1014 can include a joint 1014*b* that connects a lever 1014*a* of the grip exerciser 1014 to the handle 1012. In use, a user can grip the lever 1014*a* of the grip exerciser 1014, e.g., using his fingers, and squeeze (e.g., compress) the lever 1014*a* toward the handle 1012 to perform a grip exercise.

Figure 10B:
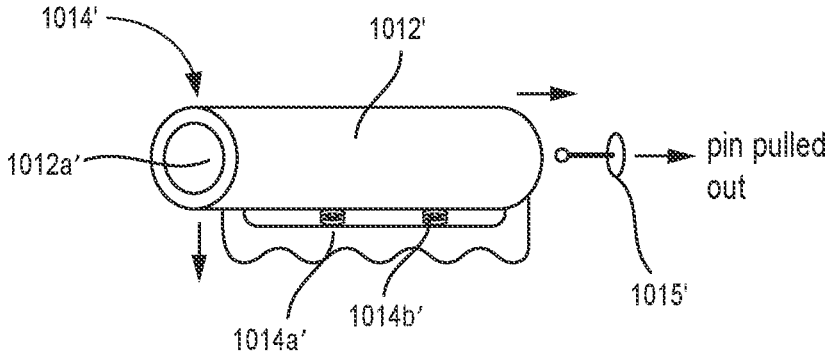
FIGS. 10B and 10C are schematic diagrams of another example grip exerciser of a mobility assist device, according to embodiments.
Figure 10C:
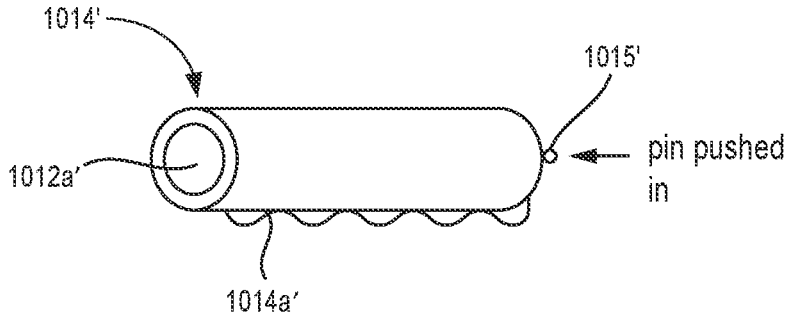

FIGS. 10B and 10C schematically depict an alternative design of a grip exerciser 1014' of a mobility assist device, according to embodiments. The grip exerciser 1014' can be used with any one of the mobility assist devices described herein, including, for example, mobility assist device 100 and walking cane 700. The grip exerciser 1014' can be structurally and/or functionally similar to the grip exerciser 1014, except that the grip exerciser 1014' can be coupled to a handle 1012' of the mobility assist device using different connectors and can be designed to fit at least partially within a hollow recess or lumen within the handle 1012' when not in use.

The grip exerciser 1014' can be movable relative to a handle 1012'. The handle 1012' can include a hollow space 1012*a*' that can receive a portion of the grip exerciser 1014' when the grip exerciser 1014' is not in use. The grip exerciser 1014' can include a lever 1014*a*' and one or more springs 1014*b*' (e.g., linear springs, leaf springs, etc.). When the springs 1014*b*' are in their resting or uncompressed state, the springs 1014*b*' can extend the grip exerciser 1014' out from the handle 1012'. When the springs 1014*b*' are compressed, the grip exerciser 1014' can be pushed into the hollow space 1012*a*' of the handle 1012'.

In some embodiments, the grip exerciser 1014' can be secured in a locked configuration, e.g., with a portion of the grip exerciser 1014' disposed within the chamber 1012*a*' of the handle 1012', using a pin 1015' or other locking element. This may allow the grip exerciser 1014' to be stored unobtrusively when not in use. The pin 1015' can be released (e.g., pulled outwards) to allow the grip exerciser 1014' to extend out from the handle 1012'.

Figure 11A:
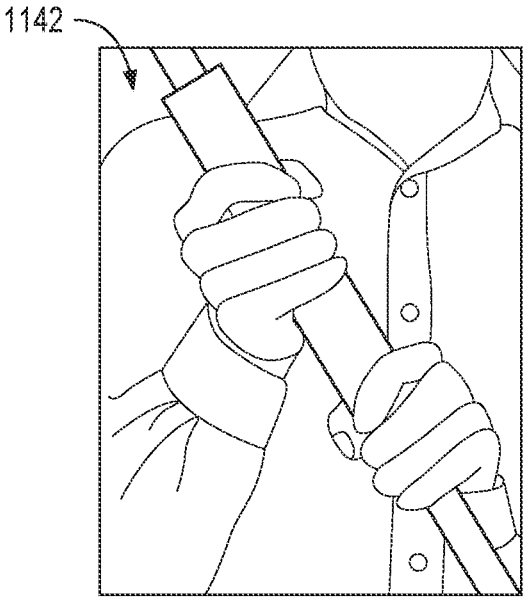
FIGS. 11A and 11B are illustrations of a user using an example torsion exerciser of a mobility assist device, according to embodiments.
Figure 11B:
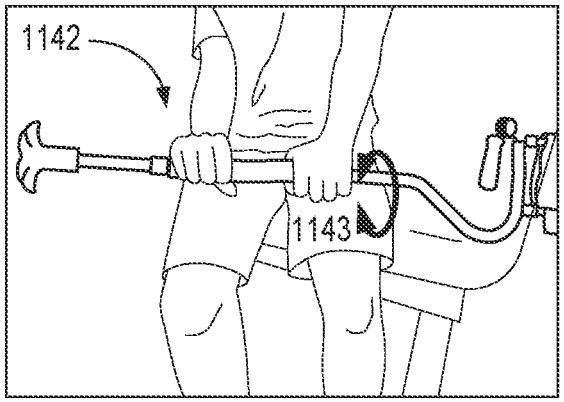

FIGS. 11A and 11B depict views of a torsion exerciser 1142 of a mobility assist device, according to embodiments. The torsion exerciser 1142 can be mounted to one or more shafts of the mobility assist device. The torsion exerciser 1142 can be used with any one of the mobility assist devices described herein, including, for example, the mobility assist device 100 and the walking cane 700. The torsion exerciser 1142 can be structurally and/or functionally similar to the torsion exerciser 742. In use, one hand of the user may rotate one end of the torsion exerciser 1142 in a clockwise direction (or first direction) and another hand of the user may rotate another end of the torsion exerciser in a counterclockwise direction (or second direction), or vice versa, as indicated by arrow 1143, to perform a torsion exercise. Alternatively, one hand of the user may grip the torsion exerciser in place while another hand of the user may rotate one end of the torsion exerciser in either the first direction or the second direction, to perform a torsion exercise. While not depicted, it can be appreciated that the torsion exerciser in some embodiments can be bent, e.g., to perform a bending exercise targeted at strengthening a user's wrists, forearms, and/or elbows.

Figure 11C:
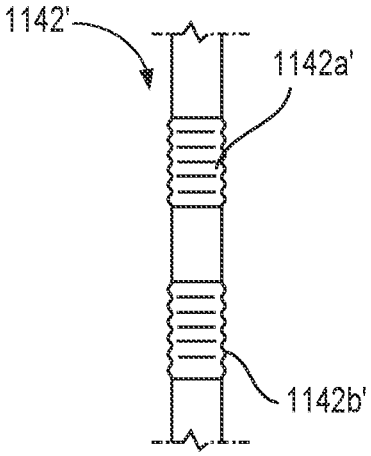
FIG. 11C is a schematic view of another example torsion exerciser of a mobility assist device, according to embodiments.

FIG. 11C depicts an alternative design of a torsion exerciser 1142' of a mobility assist device, according to embodiments. The torsion exerciser 1142' can be used with any one of the mobility assist devices described herein, including, for example, the mobility assist device 100 and the walking cane 700. The torsion exerciser 1142' can be structurally and/or functionally similar to the torsion exerciser 1142, but in contrast to the torsion exerciser 1142, the torsion exerciser 1142' can include two gripping portions 1142*a*', 1142*b*' that can be gripped by a user to rotate the torsion exerciser 1142'. While not depicted, it can be appreciated that in other embodiments, a torsion exerciser may include three or more gripping portions having predetermined length, thickness, and spacing.

Figure 12:
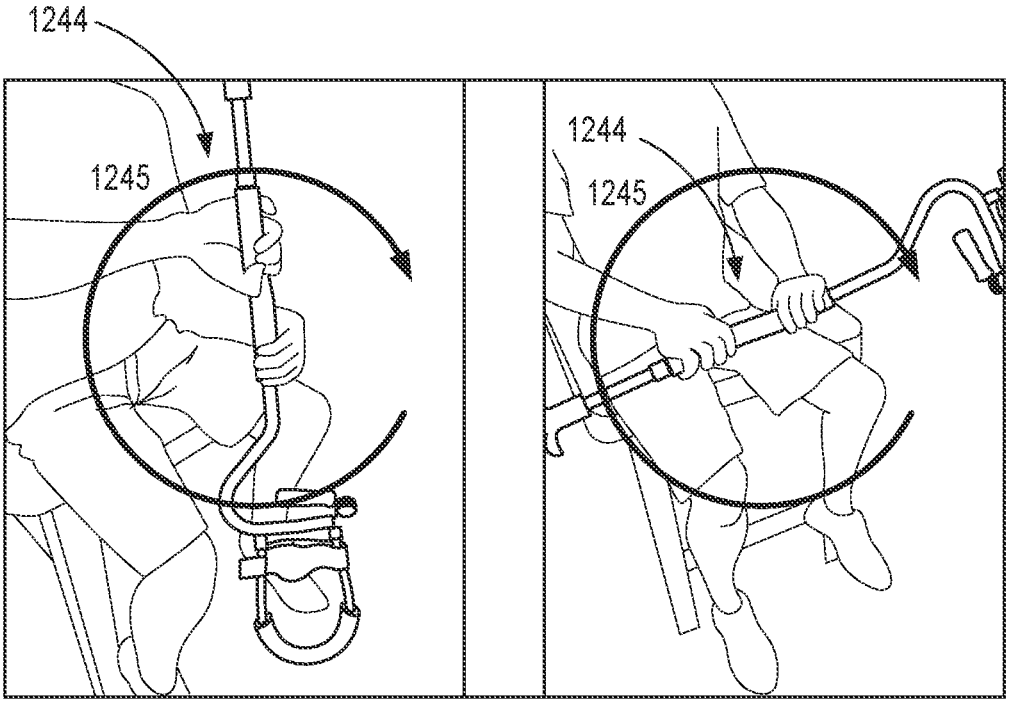
FIG. 12 depicts images of a user using an example rotation exerciser of a mobility assist device, according to embodiments.

FIG. 12 depicts images of a rotation exerciser 1244 of a mobility assist device in use, according to embodiment. The rotation exerciser 1244 may be mounted to one or more shafts of a mobility assist device. The rotation exerciser 1244 can be used with any one of the mobility assist devices described herein, including, for example, the mobility assist device 100 and the walking cane 700. As depicted, a user can grip the rotation exerciser 1244 and rotate the mobility assist device, e.g., in a circumferential manner as indicated by arrow 1245. In some embodiments, the rotation exerciser 1244 can be integrated into or be the same component as a torsion exerciser (e.g., torsion exerciser 1142 or any other torsion exercisers described herein). In such embodiments, when a user desires to perform a rotation exercise, the user can grip the torsion exerciser and use it to rotate the mobility assist device in a clockwise or counterclockwise manner. In some embodiments, the rotation exerciser 1244 can be a separate component from a torsion exerciser. For example, the torsion exerciser can be mounted on one or more shafts of a shaft assembly of a mobility assist device, and one or more additional grips for performing a rotation exercise can be mounted separately on one or more shafts of the shaft assembly.

Figure 13A:
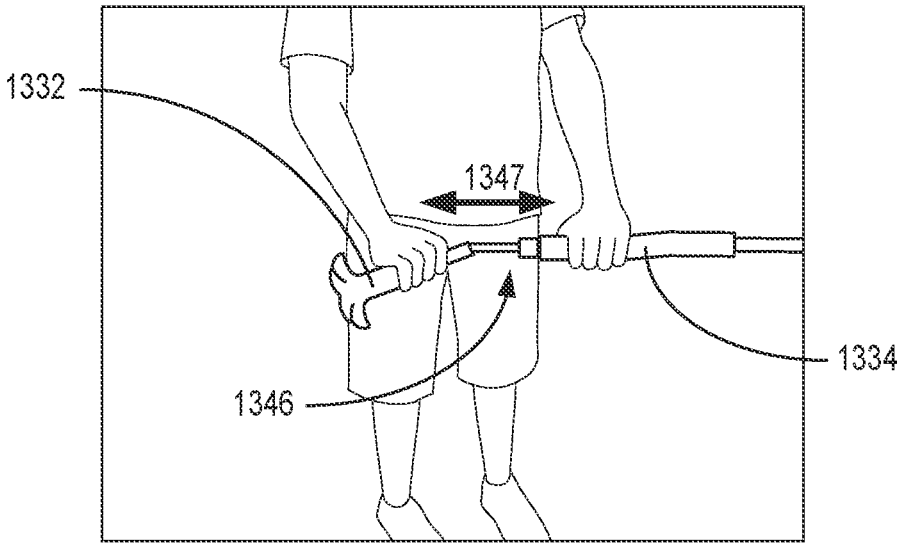
FIGS. 13A and 13B depicts images of a user using an example tension exerciser of a mobility assist device, according to embodiments.
Figure 13B:
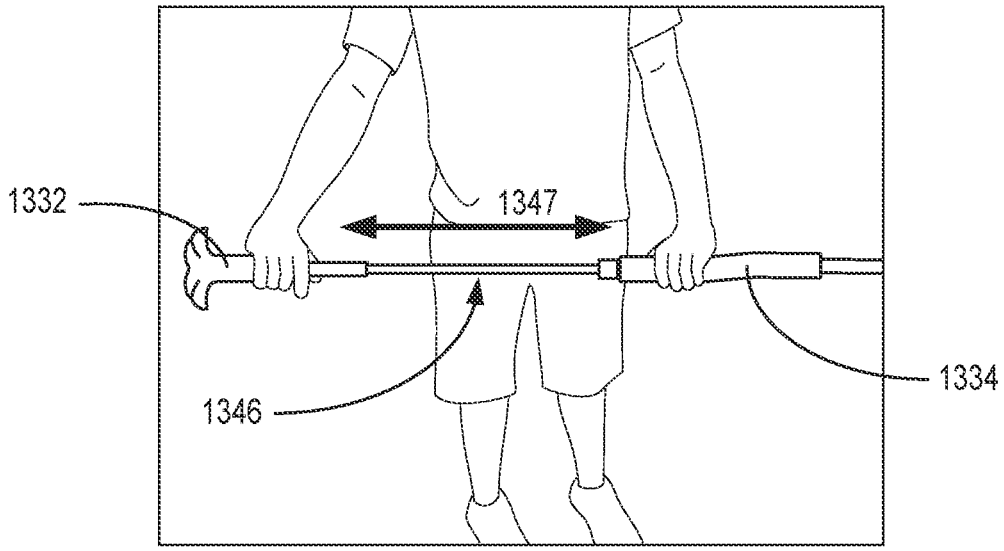

FIGS. 13A and 13B depict a tension exerciser of a mobility assist device in use, according to embodiments. The tension exerciser can be used with any one of the mobility assist devices described herein, including, for example, mobility assist device 100 and walking cane 700. The tension exerciser can be incorporated into a shaft assembly of the mobility assist device. For example, the tension exerciser can be coupled at its ends to different shafts 1332, 1334 of the shaft assembly. The tension exerciser can include an elastomeric or elastic member 1346 (e.g., a resistance band or tubing) that can be stretched in tension, as indicated by arrow 1347, to perform a tension exercise. For example, FIGS. 13A and 13B shows a user holding shaft 1334 in place while pulling shaft 1332 away from shaft 1334 (e.g., in a direction parallel to a longitudinal axis of the shaft assembly) to extend the elastomeric member 1346. In some embodiments, the shafts 1332, 1334 can be held at an angle while the elastomeric member 1346 is stretched in tension.

Figure 13C:
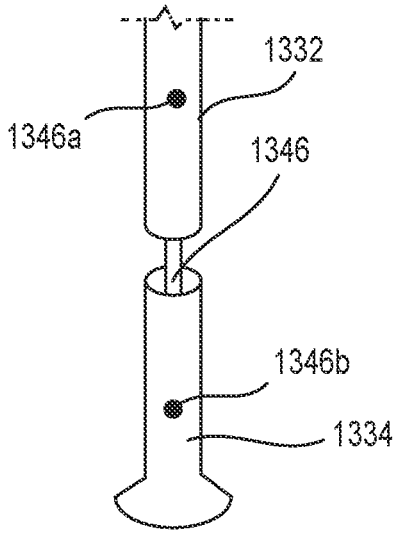
FIG. 13C schematically depicts an example tension exerciser of a mobility assist device in a stretched configuration, according to embodiments.
Figure 13D:
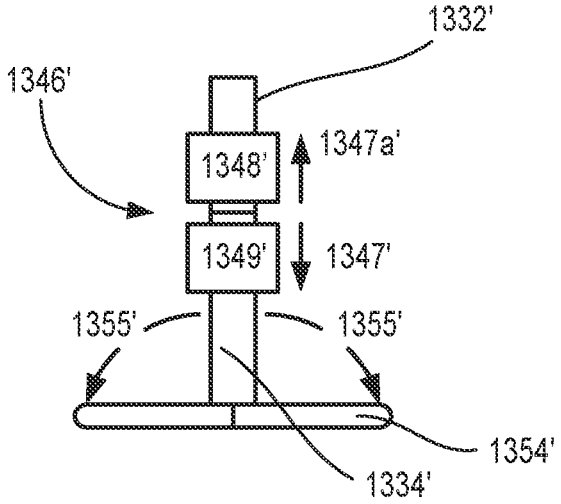
FIG. 13D schematically depicts an example of a footrest of a mobility assist device for use with a tension exerciser of the mobility assist device, according to embodiments.

FIGS. 13C and 13D schematically depict alternative designs of tension exercisers of a mobility assist device, according to embodiments. The tension exercisers depicted in FIGS. 13C and 13D can include components that are structurally and/or functionally similar to other tension exercisers described herein. The tension exerciser of FIG. 13C may be configured to be pulled apart using a pair of hands of a user (or one or more hands or feet of a user) and can include a first shaft 1332, a second shaft 1334, and an elastomeric member 1346 coupled therebetween. A first end 1346*a* of the elastomeric member 1346 may be coupled to an inner surface or structure of the first shaft 1332, and a second end 1346*b* of the elastomeric member 1346 may be coupled to an inner surface or structure of the second shaft 1334.

The tension exerciser of FIG. 13D includes a first shaft 1332', second shaft 1334', and a tension exerciser 1346'. A first grip 1348' may be disposed on a surface of the first shaft 1332' and a second grip 1349' may be disposed on a surface of the second shaft 1334'. An end of the second shaft 1334' may be coupled to a foldable footrest 1354' configured to transition between a closed configuration where the footrest 1354' extends generally parallel to a longitudinal axis of the second shaft 1334' and an open configuration 1355' where the footrest 1354' extends laterally away from the longitudinal axis of the second shaft 1334'. The footrest 1354' can be structurally and/or functionally similar to the footrest 154 described with reference to FIG. 1. In some embodiments, a user may place one or more feet on the footrest 1354' and hold the first grip 1348' and either pull the first shaft 1332' away from the footrest 1354' using the hand, push the footrest 1354' away from the first shaft 1332' using the feet, or do both at once. When not in use, the footrest 1354' can be folded so that it does not interfere with a user of the mobility assist device for a different purpose, e.g., walking.

Figure 14:
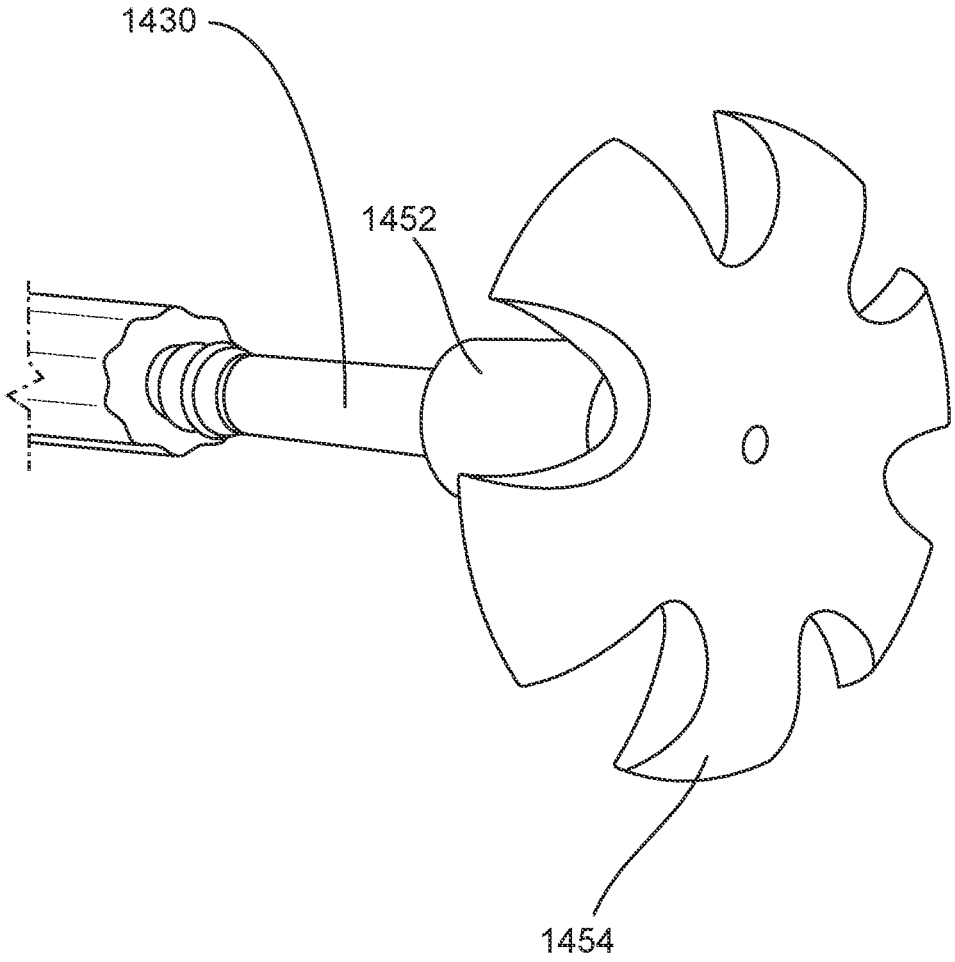
FIG. 14 is an image of an example base of a mobility assist device, according to embodiments.

FIG. 14 is an image of a base 1452 of a mobility assist device including a plurality of legs 1454 that extend laterally away from a longitudinal axis of the mobility assist device. The legs 1454 can provide increased stability to the mobility assist device. The legs 1454 can have a predetermined length and in some embodiments, may be configured to have an open configuration where the legs 1454 extend laterally away from the longitudinal axis of the mobility assist device and a closed configuration where the legs 1454 extend generally in parallel to the longitudinal axis of the mobility assist device. For example, the legs 1454 may include a hinge (not shown) configured to transition the legs 1454 between the open and closed configuration. In some embodiments, a user can switch between different bases to accommodate different terrain, as described above with reference to mobility assist device 100 and kit 400.

II. Methods

Figure 5:
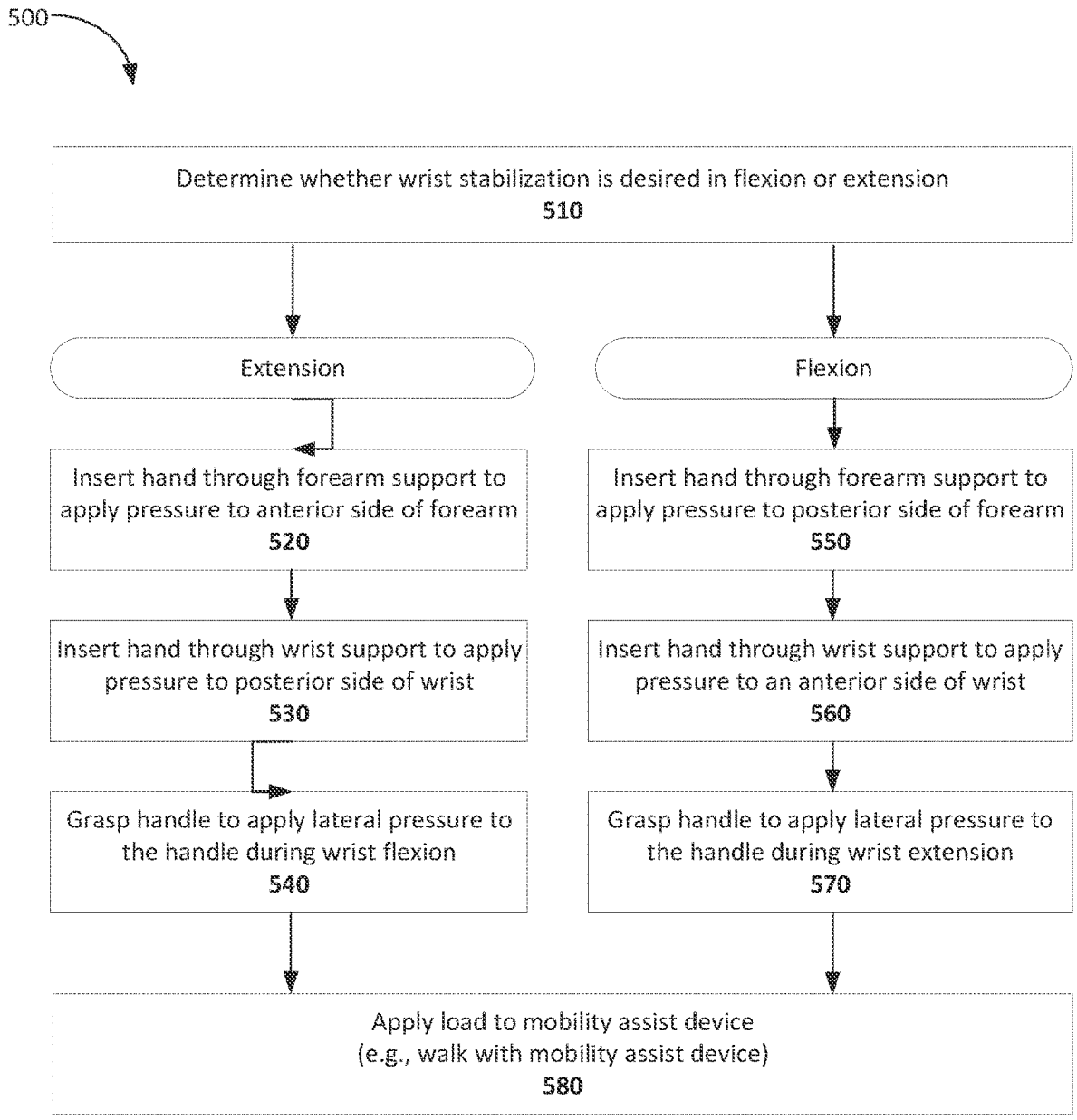
FIG. 5 is a flowchart of an example method of using a wrist stabilizer of a mobility assist device, according to embodiments.

FIG. 5 is a flowchart of a method 500 of using a wrist stabilizer (e.g., any of the wrist stabilizers described herein, including wrist stabilizer 120, 220) of a mobility assist device such as a walking cane. The method 500 includes determining whether wrist stabilization is desired in flexion or extension, at 510. If wrist stabilization is desired in extension, then a user can insert his hand through a forearm support (e.g., forearm support 222) of the wrist stabilizer such that pressure is applied to an anterior side of his forearm when he uses the mobility assist device, at 520. The user can further insert his hand through a wrist support (e.g., wrist support 224) of the wrist stabilizer such that pressure is applied to a posterior side of his wrist when he uses the mobility assist device, at 530. And the user can grasp a handle (e.g., handle 112, 212) of the mobility assist device such that lateral pressure can be applied to the handle during wrist extension, at 540. After the user has appropriately positioned his hand, wrist, and forearm, the user can then use the mobility assist device, at 580, e.g., to support the user during walking. The user's hand, wrist, and forearm being supported as such by the wrist stabilizer can prevent undesired motion (e.g., twisting and/or buckling) and injury during use of the mobility assist device.

If wrist stabilization is desired in flexion, then the user can position his hand, wrist, and forearm in an opposite arrangement relative to one or more components of the wrist stabilizer, as described with reference to 550-570. At 550, the user can insert his hand through a forearm support such that pressure is applied to a posterior side of his forearm when he uses the mobility assist device. The user can further insert his hand through a wrist support such that pressure is applied to an anterior side of his wrist when he uses the mobility assist device, at 560. And the user can grasp a handle such that lateral pressure can be applied to the handle during wrist extension, at 570. After the user has appropriately positioned his hand, wrist, and forearm, the user can then use the mobility assist device, at 580, e.g., to support the user during walking. The user's hand, wrist, and forearm being supported as such by the wrist stabilizer can prevent undesired motion (e.g., twisting and/or buckling) and injury during use of the mobility assist device.

Figure 6:
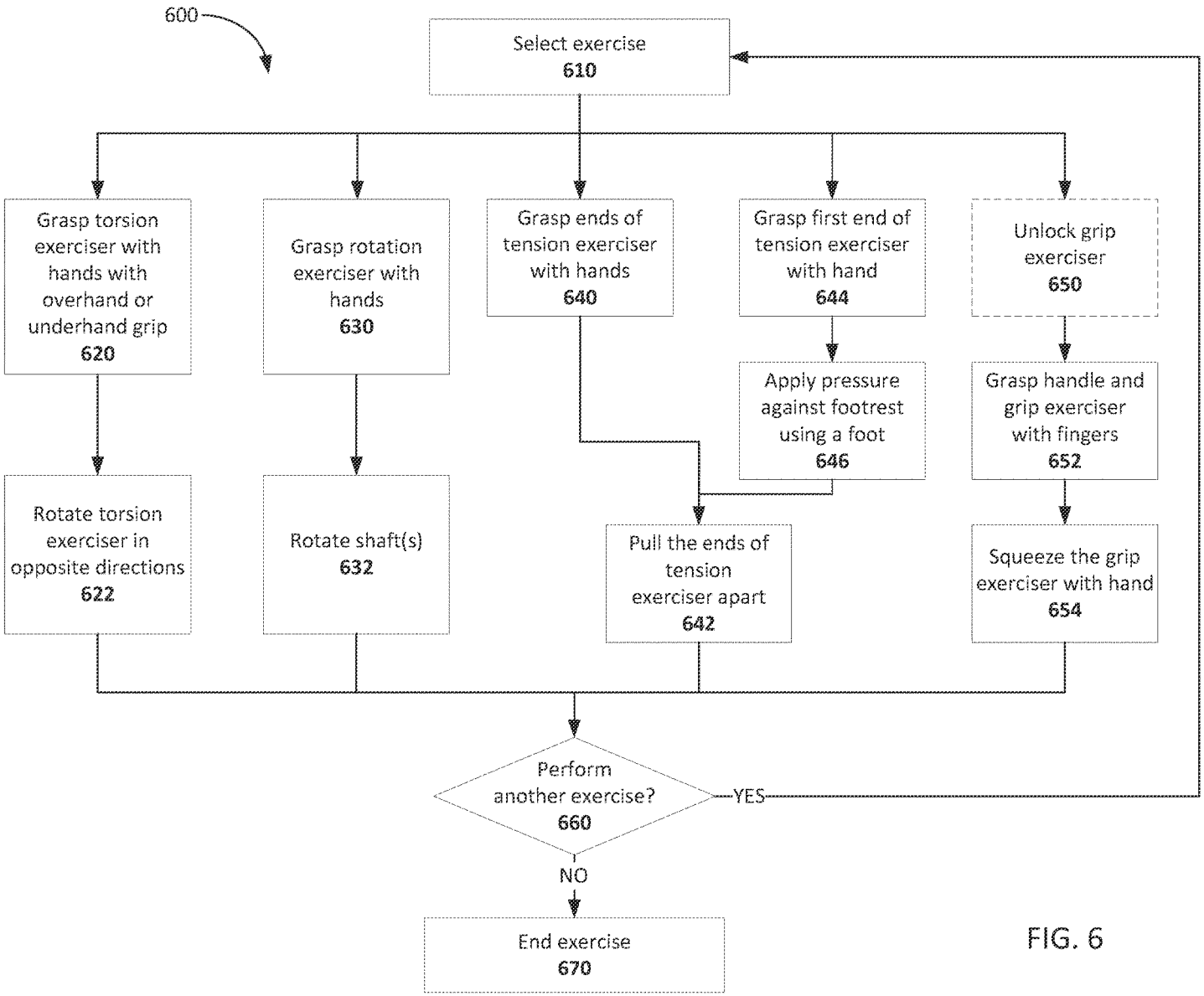
FIG. 6 is a flowchart of an example method of using one or more exercising components of a mobility assist device, according to embodiments.

FIG. 6 is a flowchart of a method 600 of using one or more exercising elements (e.g., any of the exercising elements described herein, including torsion exerciser 142, 342, rotation exerciser 144, 344*a*, 344*b*, tension exerciser 146, 346, and grip exerciser 114) of a mobility assist device such as a walking cane, according to embodiments. The method 600 may include selecting, at 610, an exercise from a set of exercises such as torsion (e.g., 620, 622), rotation (e.g., 630, 632), tension (e.g., 640, 642, 644, 646), and grip (e.g., 650, 652, 654). For a torsion exercise, a torsion exerciser may be grasped with two hands with an overhand or underhand grip, at 620. The torsion exerciser may be rotated in opposite directions, at 622. For a rotation exercise, a rotation exerciser may be grasped with two hands, at 630. The user may use his arms to rotate the mobility assist device, e.g., in a circumferential manner, at 632. For a tension exercise, opposite ends of the tension exerciser may be grasped with two hands, at 640. The ends of the tension exerciser may be pulled away from each other one or more times, at 642. Alternatively, one end of the tension exerciser may be grasped with one hand, at 644, and a footrest can be used to hold a base of the mobility assist device, at 646. A user can then extend the tension exerciser by pulling on the end of the tension exerciser using his hand or by pushing the base of the mobility assist device using his foot or feet, at 642. For a grip exercise, a grip exerciser can optionally be unlocked, at 650, e.g., as described with reference to FIGS. 10B and 10C. The user can grip the grip exerciser using his palm and fingers, at 652. The grip exerciser can then be squeezed, at 652.

In some embodiments, a user can perform more than one exercise (660: YES), and can select to perform a second exercise after performing a first exercise, at 610. In some embodiments, a user can perform a series of exercises according to an exercise routine. For example, a user can cycle through a number of exercises according to a predefined routine (e.g., perform about 10-15 rotation exercises twice daily, perform about 10-15 torsion exercises twice daily, perform about 10-15 tension exercises twice daily). In some embodiments, a user can focus on certain exercises to increase strength in one specific area. In some embodiments, an instruction manual can be provided with a mobility assist device as described herein, and the instruction manual can provide guidance to a user on how to use the exercising elements of the mobility assist device and include predefined routines for exercising.

If no further exercises are desired (660: NO), then the user can end the exercise session, at 670.

All embodiments of any aspect of the disclosure can be used in combination, unless the context clearly dictates otherwise.

While embodiments of the present invention have been shown and described herein, those skilled in the art will understand that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

Also, various concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

As used herein, in particular embodiments, the terms "about" or "approximately" when preceding a numerical value indicates the value plus or minus a range of 10%. Where a range of values is provided, it is understood that each intervening value, to the tenth of the unit of the lower limit unless the context clearly dictates otherwise, between the upper and lower limit of that range and any other stated or intervening value in that stated range is encompassed within the disclosure. That the upper and lower limits of these smaller ranges can independently be included in the smaller ranges is also encompassed within the disclosure, subject to any specifically excluded limit in the stated range. Where the stated range includes one or both of the limits, ranges excluding either or both of those included limits are also included in the disclosure.

The invention claimed is:

1. An apparatus, comprising:

a shaft assembly including first and second shafts that are adjustable relative to one another;

a handle coupled to a first end of the shaft assembly;

a wrist stabilizer including a wrist support and a forearm support, the wrist stabilizer coupled to the handle, wherein the apparatus terminates at a proximal end thereof at the wrist stabilizer, the wrist stabilizer, when used in a first configuration in which the forearm support is configured to be in contact with a posterior side of a forearm of a user and the wrist support is configured to be in contact with an anterior side of a wrist of the user while the user is gripping the handle with a hand of the user, configured to provide support to the user when the forearm and the wrist of the user are in flexion, the wrist stabilizer, when used in a second configuration in which the forearm support is configured to be in contact with an anterior side of the forearm of the user and the wrist support is configured to be in contact with a posterior side of the wrist of the user, further configured to provide support to the user when the forearm and the wrist of the user are in extension; and a base coupled to a second end of the shaft assembly opposite the first end of the shaft assembly.

2. The apparatus of claim 1, wherein the wrist stabilizer includes a frame, and the forearm support includes a hinge coupled to the frame.

3. The apparatus of claim 1, wherein the forearm support includes a flexible portion configured to enable one or more of translation and rotation of the forearm support relative to a longitudinal axis of the wrist stabilizer.

4. The apparatus of claim 1, further comprising:

a grip exerciser coupled to the handle via one or more coupling elements, the one or more coupling elements configured to provide resistance to a displacement of the grip exerciser, the grip exerciser configured to displace relative to the handle to allow the user to perform a grip exercise.

5. The apparatus of claim 4, wherein the grip exerciser is configured to release from a recess of the handle or the first shaft.

6. The apparatus of claim 4, wherein the one or more coupling elements includes a spring.

7. The apparatus of claim 1, further comprising:

a torsion exerciser coupled to at least one of the first and second shafts of the shaft assembly, the torsion exerciser having opposite ends configured to be rotated in opposite directions about a longitudinal axis of the shaft assembly, the torsion exerciser configured to provide resistance in torsion when the opposite ends of the torsion exerciser are rotated.

8. The apparatus of claim 7, wherein the torsion exerciser includes one or more elastic elements.

9. The apparatus of claim 1, further comprising:

a tension exerciser having a first end coupled to the first shaft of the shaft assembly and a second end coupled to the second shaft of the shaft assembly that is adjacent to the first shaft, the first and second shafts movable relative to one another, the tension exerciser configured to provide resistance in tension when the first and second shafts are moved away from one another.

10. The apparatus of claim 9, wherein the tension exerciser includes one or more elastic elements.

11. The apparatus of claim 9, wherein the first end is coupled to an inner surface of the first shaft and the second end is coupled to an inner surface of the second shaft.

12. The apparatus of claim 1, further comprising:

one or more grips coupled to at least one of the first and second shafts of the shaft assembly, the one or more grips configured to be gripped by the user while rotating the shaft assembly in a clockwise or counterclockwise manner.

13. The apparatus of claim 1, wherein the base includes a footrest configured to transition from a closed configuration extending generally parallel to a longitudinal axis of the shaft assembly and an open configuration extending generally laterally away from the longitudinal axis of the shaft assembly.

14. The apparatus of claim 13, wherein the footrest includes one or more legs at an end of the base.

15. A method, comprising:

inserting a hand of a user through a forearm support of a wrist stabilizer of a mobility assist device to apply pressure to an anterior side of a forearm of the user, wherein the mobility assist device terminates at a proximal end thereof at the wrist stabilizer;

inserting the hand through a wrist support of the wrist stabilizer to apply pressure to a posterior side of a wrist of the user;

grasping with the hand a handle of the mobility assist device coupled to the wrist stabilizer to apply lateral pressure to the handle while the wrist stabilizer supports the forearm and the wrist of the user in extension;

removing the hand of the user from the wrist stabilizer;

inserting the hand through the forearm support to apply pressure to a posterior side of the forearm of the user;

inserting the hand through the wrist support to apply pressure to an anterior side of the wrist of the user; and grasping with the hand the handle to apply lateral pressure to the handle while the wrist stabilizer supports the forearm and the wrist of the user in flexion.

16. The method of claim 15, further comprising squeezing a grip exerciser coupled to the handle using the hand of the user.

17. The method of claim 15, further comprising rotating opposite ends of a torsion exerciser of the mobility assist device in opposite directions.

18. The method of claim 15, further comprising pulling opposing ends of a tension exerciser of the mobility assist device away from each other.

19. A kit, comprising:

a shaft assembly including first and second shafts that are adjustable relative to one another;

a handle coupleable to a first end of the shaft assembly;

a wrist stabilizer including a wrist support and a forearm support, the wrist stabilizer coupleable to the handle such that (1) the wrist stabilizer is configured to provide support in flexion of a forearm and a wrist of the user when the user rests the forearm of the user on a first side of the forearm support and the wrist of the user on a first side of the wrist support while gripping the handle with a hand of the user and (2) the wrist stabilizer is configured to provide support in extension of the forearm and the wrist of the user when the user rests the forearm of the user on a second side of the forearm support and the wrist of the user on a second side of the wrist support while gripping the handle with the hand of the user; and a base coupleable to a second the opposite end of the shaft assembly opposite the first end of the shaft assembly, wherein, when the shaft assembly, the handle, the wrist stabilizer, and the base are respectively coupled together as an apparatus, the apparatus terminates at a proximal end thereof at the wrist stabilizer.

20. The kit of claim 19, further comprising a set of exercisers coupleable to the shaft assembly.

21. The kit of claim 19, wherein the base comprises a set of different bases.

22. The kit of claim 19, further comprising:

a grip exerciser coupleable to the handle via one or more coupling elements, the one or more coupling elements configured to provide resistance to a displacement of the grip exerciser, the grip exerciser configured to displace relative to the handle to allow the user to perform a grip exercise.

23. The kit of claim 19, further comprising:

a torsion exerciser coupleable to at least one shaft of the shaft assembly, the torsion exerciser having opposite ends configured to be rotated in opposite directions about a longitudinal axis of the shaft assembly, the torsion exerciser configured to provide resistance in torsion when the opposite ends of the torsion exerciser are rotated.

24. The kit of claim 19, further comprising:

a tension exerciser having a first end coupleable to the first shaft of the shaft assembly and a second end coupled to the second shaft of the shaft assembly that is adjacent to the first shaft, the first and second shafts movable relative to one another, the tension exerciser configured to provide resistance in tension when the first and second shafts are moved away from one another.

25. The kit of claim 19, further comprising:

one or more grips coupleable to at least one of the first and second shafts of the shaft assembly, the one or more grips configured to be gripped by the user while rotating the shaft assembly in a clockwise or counterclockwise manner.

26. The kit of claim 19, wherein the base includes a footrest configured to transition from a closed configuration extending generally parallel to a longitudinal axis of the shaft assembly and an open configuration extending generally laterally away from the longitudinal axis of the shaft assembly.

* * * * *